US012137773B2

(12) United States Patent
Chen

(10) Patent No.: US 12,137,773 B2
(45) **Date of Patent: *Nov. 12, 2024**

(54) FASTENING DEVICE

(71) Applicant: Chin-Chu Chen, Taichung (TW)

(72) Inventor: Chin-Chu Chen, Taichung (TW)

( * ) Notice: Subject to any disclaimer, the term of this patent is extended or adjusted under 35 U.S.C. 154(b) by 362 days.

This patent is subject to a terminal disclaimer.

(21) Appl. No.: 17/584,404

(22) Filed: Jan. 26, 2022

(65) Prior Publication Data

US 2022/0142304 A1 May 12, 2022

Related U.S. Application Data

(63) Continuation-in-part of application No. 16/558,181, filed on Sep. 2, 2019, now Pat. No. 11,266,206.

(30) Foreign Application Priority Data

Apr. 25, 2019 (TW) ..... 108114559

(51) Int. Cl.
*A43C 11/16* (2006.01)
*A43C 11/00* (2006.01)
*B65H 75/44* (2006.01)

(52) U.S. Cl.
CPC ..... *A43C 11/165* (2013.01); *A43C 11/008* (2013.01); *B65H 75/4421* (2013.01); *B65H 75/4455* (2013.01); *B65H 75/4471* (2013.01); *B65H 75/4494* (2013.01)

(58) Field of Classification Search
CPC . A43C 11/165; A43C 11/008; B65H 75/4421; B65H 75/4455; B65H 75/4471; B65H 75/4494
See application file for complete search history.

(56) References Cited

U.S. PATENT DOCUMENTS

| | | | |
|---|---|---|---|
| 10,100,975 | B2 | 10/2018 | Chen |
| 2007/0084956 | A1 | 4/2007 | Chen |
| 2011/0191992 | A1 | 8/2011 | Chen |
| 2012/0228419 | A1 | 9/2012 | Chen |
| 2014/0359981 | A1 | 12/2014 | Cotterman et al. |
| 2015/0230560 | A1 | 8/2015 | Chen |
| 2016/0120267 | A1 | 5/2016 | Burns et al. |
| 2017/0082242 | A1 | 3/2017 | Chen |

(Continued)

FOREIGN PATENT DOCUMENTS

| | | | |
|---|---|---|---|
| CN | 202566580 | U | 12/2012 |
| CN | 204895922 | U | 12/2015 |

(Continued)

*Primary Examiner* — Sang K Kim
(74) *Attorney, Agent, or Firm* — CKC & Partners Co., LLC

(57) ABSTRACT

A fastening device includes a case unit, a spool, a connecting unit, a knob and an engaging unit. The case unit includes a wall forming a receiving space, a partition separates the receiving space into an upper chamber and a lower chamber, a through hole located at the partition, and a base detachably connected to at least one part of the wall. The spool is located at the lower chamber. The knob is connected to the connecting unit. The engaging unit is located at the upper chamber. After the connecting unit is inserted into the spool, the through hole and the engaging unit to couple to the knob, the partition, the spool, the connecting unit, the knob and the engaging unit are connected integrally without being separated from each other while the base is separated from the at least one part of the wall.

12 Claims, 28 Drawing Sheets

(56) References Cited

U.S. PATENT DOCUMENTS

| | | | |
|---|---|---|---|
| 2017/0295888 | A1 | 10/2017 | Chen |
| 2017/0304102 | A1 | 10/2017 | Turrini et al. |
| 2017/0325548 | A1 | 11/2017 | Ha |
| 2019/0000187 | A1 | 1/2019 | Chen |
| 2019/0144150 | A1 | 5/2019 | Chen |
| 2019/0150569 | A1 | 5/2019 | Chen |

FOREIGN PATENT DOCUMENTS

| | | | |
|---|---|---|---|
| CN | 206213402 | U | 6/2017 |
| JP | 2017513679 | A | 6/2017 |
| JP | 2018509185 | A | 4/2018 |
| KR | 101040372 | B1 | 6/2011 |
| KR | 101661233 | B1 | 9/2016 |
| KR | 101688997 | B1 | 12/2016 |
| KR | 1020170021735 | A | 2/2017 |
| KR | 20170122462 | A | 11/2017 |
| KR | 1020190010579 | A | 1/2019 |
| WO | 2018137274 | A1 | 8/2018 |

100a

FASTENING DEVICE

RELATED APPLICATIONS

The present application is a Continuation-in-part of U.S. application Ser. No. 16/558,181, filed Sep. 2, 2019, which claims priority to Taiwan Application Serial Number 108114559, filed Apr. 25, 2019, all of which are herein incorporated by reference.

BACKGROUND

Technical Field

The present disclosure relates to a fastening device. More particularly, the present disclosure relates to a fastening device for securing an article through loosening or tightening a lace.

Description of Related Art

In daily life, cords, such as a lace or a thread, are usually used to tighten articles. The most common tightening method is to use the cord to reciprocately pass through holes on the article, e.g., eyelets of a shoe, and then tie a knot to secure the article. But in this kind of tightening method, the knot is loosened easily owing to an external force. Not only does the knot need to be tied again, but also lots of inconveniences come owing to the insecurity of the articles.

In order to solve such problems, some practitioners developed a simple fastening mechanism including a case, an engaging unit and a spring. The case includes holes configured for the lace to pass therethrough. Through the reaction force between the spring and the engaging unit, the lace can be clamped between the engaging unit and the case so as to be fastened. The length of the lace can be changed by pressing the spring to change the position of the engaging unit. However, in such fastening mechanism, the restoring force of the spring is served as the securing force; thus, the lace is easily to be released owing to vibrations or an external force. In addition, the fastening mechanism has no space for receiving the lace, and the exposure of the lace may bring danger.

Therefore, some practitioners developed another kind of buckle which can be rotated to tighten the lace, and the lace can be received inside the buckle. Through the interference between components inside the buckle, the length of the lace as well as the tightness can be adjusted. However, the structure of the buckle is complex; as a result, the manufacturing cost is increased, and the buckle has assembly and repair difficulty.

Based on the above-mentioned problems, how to simplify the structure of the fastening device, reduce the manufacturing cost and maintain the securing capability becomes a pursuit target for practitioners.

SUMMARY

According to one aspect of the present disclosure, a fastening device includes a case unit, a spool, a connecting unit, a knob and an engaging unit. The case unit includes a wall forming a receiving space, a partition protruding radially from the wall to separate the receiving space into an upper chamber and a lower chamber, a through hole located at the partition, and a base detachably connected to at least one part of the wall. The spool is located at the lower chamber. The connecting unit is inserted into the spool. The knob covers on the case unit and is connected to the connecting unit. The engaging unit is located at the upper chamber. After the connecting unit is inserted into the spool, the through hole and the engaging unit to couple to the knob, the partition, the spool, the connecting unit, the knob and the engaging unit are connected integrally without being separated from each other while the base is separated from the at least one part of the wall.

BRIEF DESCRIPTION OF THE DRAWINGS

The disclosure can be more fully understood by reading the following detailed description of the embodiments, with reference made to the accompanying drawings as follows.

DETAILED DESCRIPTION

It will be understood that when an element (or mechanism or module) is referred to as being "disposed on", "connected to" or "coupled to" another element, it can be directly disposed on, connected or coupled to the other one element, or it can be indirectly disposed on, connected or coupled to the other one element, that is, intervening elements may be present. In contrast, when an element is referred to as being "directly disposed on," "directly connected to" or "directly coupled to" another element, there are no intervening elements present.

In addition, the terms first, second, third, etc. are used herein to describe various elements or components, these elements or components should not be limited by these terms. Consequently, a first element or component discussed below could be termed a second element or component.

Figure 1:
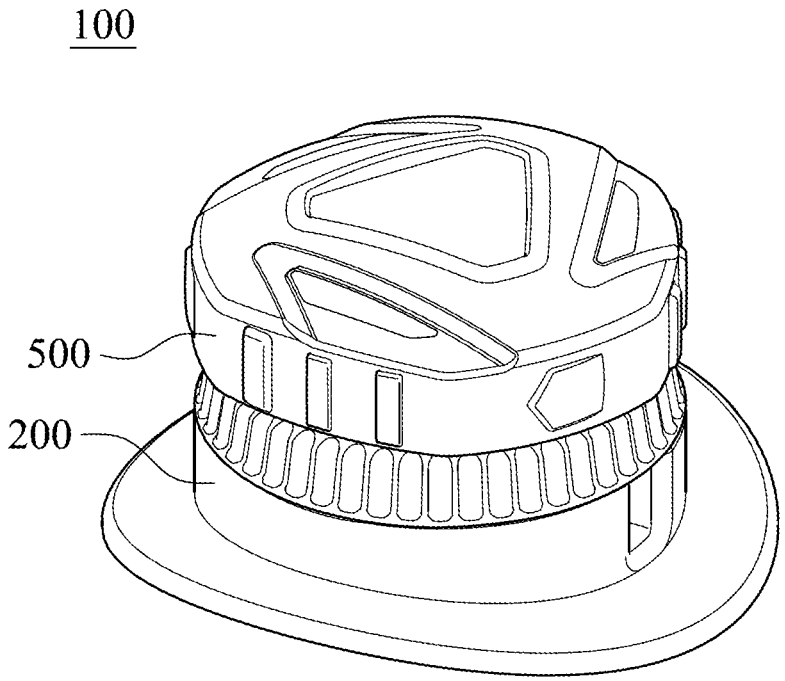
FIG. 1 shows a three dimensional schematic view of a fastening device according to a first embodiment of the present disclosure.
Figure 2:
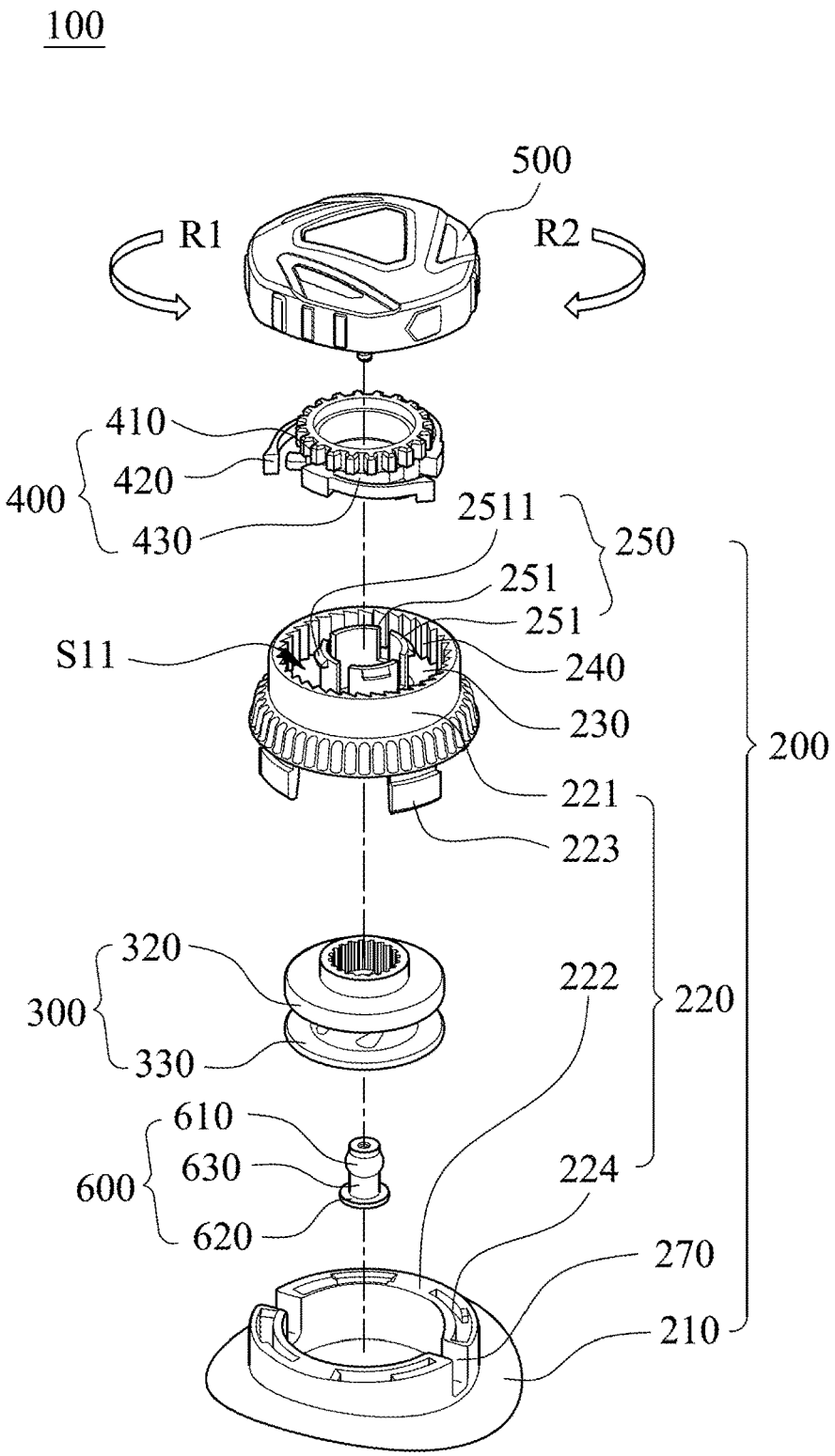
FIG. 2 shows one exploded view of the fastening device of FIG. 1.
Figure 3:
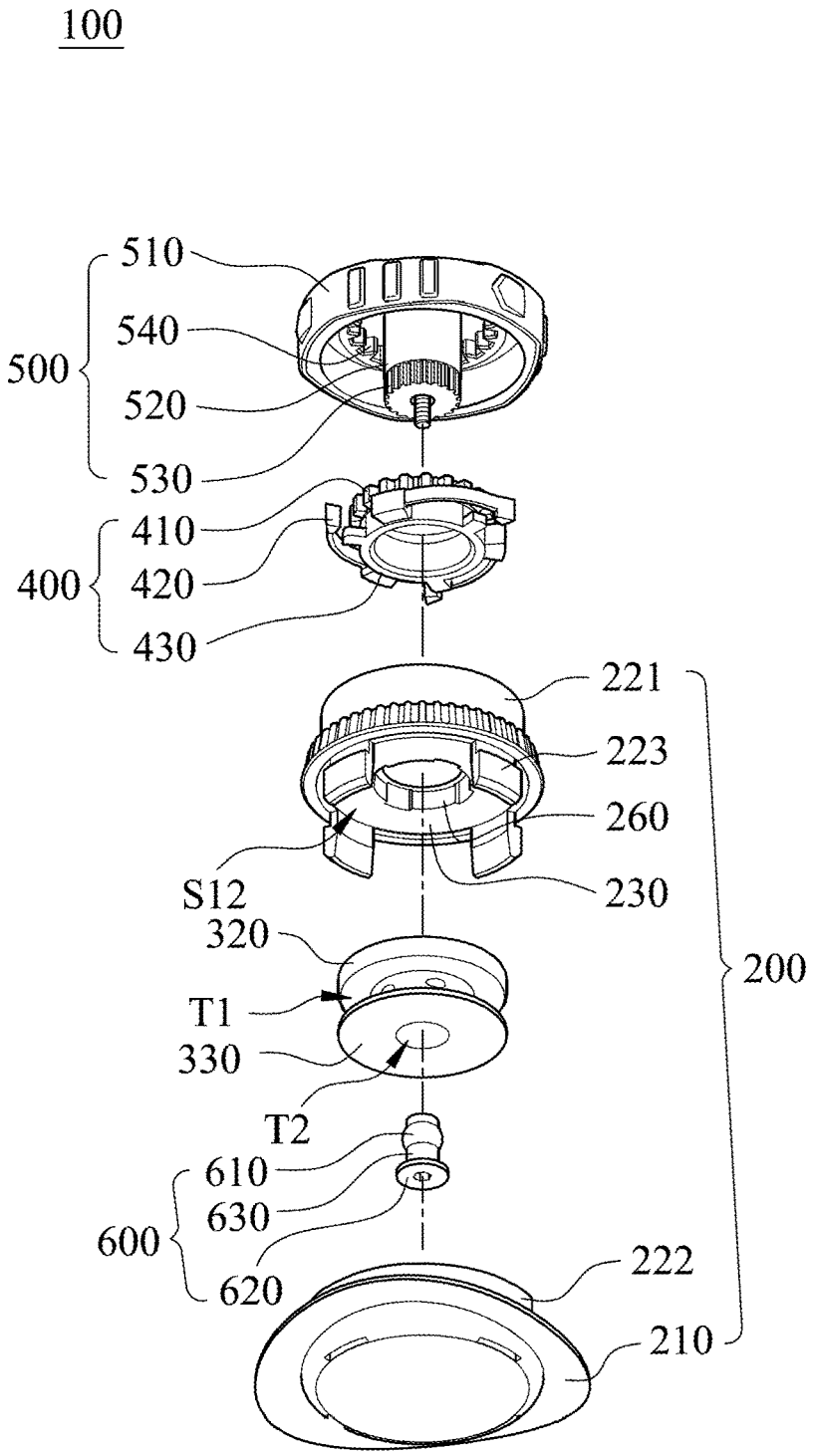
FIG. 3 shows another exploded view of the fastening device of FIG. 1.
Figure 4:
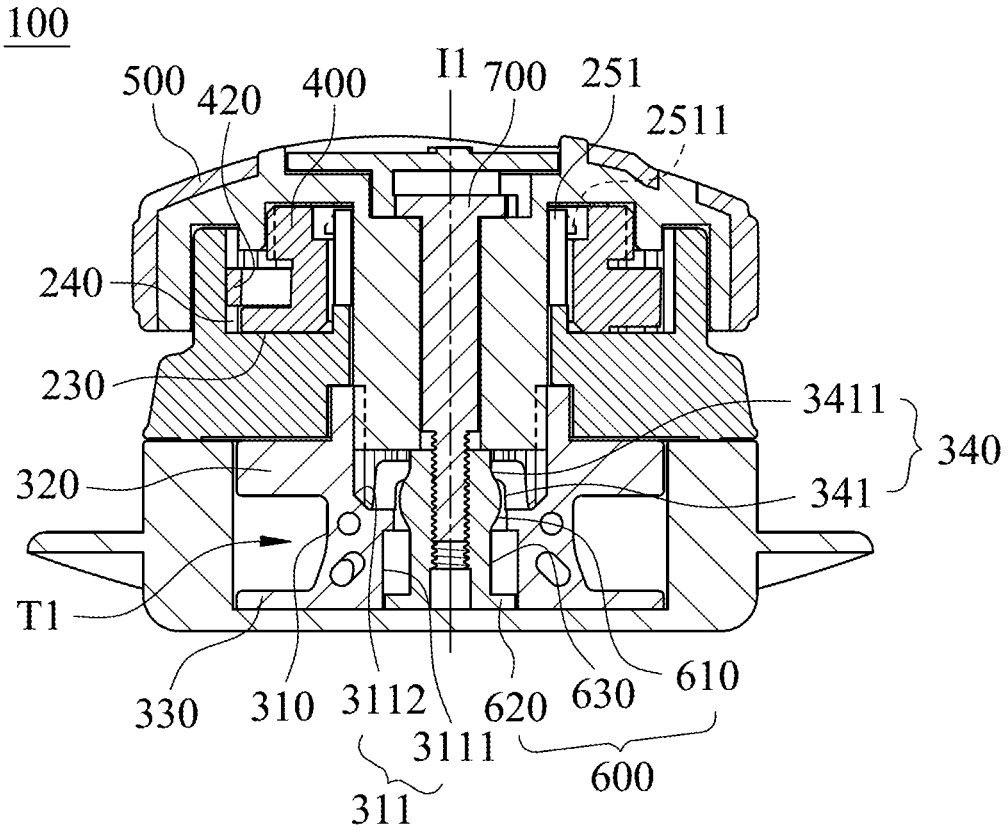
FIG. 4 shows one cross-sectional view of the fastening device of FIG. 1.
Figure 5:
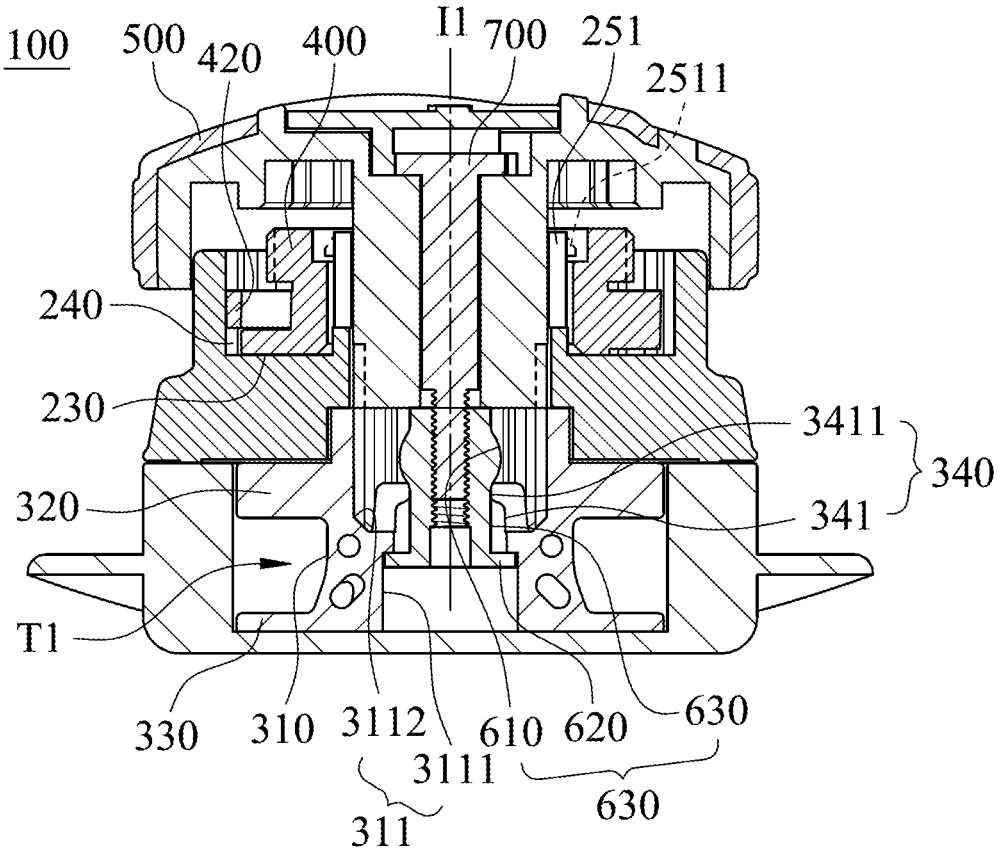
FIG. 5 shows another cross-sectional view of the fastening device of FIG. 1.

FIG. 1 shows a three dimensional schematic view of a fastening device 100 according to a first embodiment of the present disclosure. FIG. 2 shows one exploded view of the fastening device 100 of FIG. 1. FIG. 3 shows another exploded view of the fastening device 100 of FIG. 1. FIG. 4 shows one cross-sectional view of the fastening device 100 of FIG. 1. FIG. 5 shows another cross-sectional view of the fastening device 100 of FIG. 1. As shown in FIG. 1 to FIG. 5, the fastening device 100 includes a case unit 200, a knob 500 and an engaging unit 400.

The case unit 200 includes a wall 220 forming a receiving space (not labeled) and a plurality of mounting teeth 240 located at the wall 220 and facing toward the receiving space. The knob 500 covers on the case unit 200. The engaging unit 400 is within the receiving space. The engaging unit 400 corresponds to the mounting teeth 240 and is selectively coupled to the knob 500. The knob 500 is switched between a first position and a second position along an axial direction I1. When the knob 500 is in the first position to couple to the engaging unit 400, the engaging unit 400 is linked up with the knob 500 and the engaging unit 400 is engaged with one of the mounting teeth 240 to prohibit the knob 500 from rotating in a first direction R1, and when the knob 500 is in the second position to disengage from the engaging unit 400, the engaging unit 400 does not prohibit the knob 500 from rotating in the first direction R1.

Hence, since the knob 500 is the only one which moves along the axial direction I1, and the engaging unit 400 is remained in the original position, the structure reliability is increased. The details of the fastening device 100 will be described in the following paragraphs.

The case unit 200 can include the wall 220, a partition 230 and the plurality of mounting teeth 240. The partition 230 protrudes radially from the wall 220 to separate the receiving space into an upper chamber S11 and a lower chamber S12. The engaging unit 400 is located at the upper chamber S11. To be more specific, the case unit 200 can further include a base 210, and the wall 220 can include an upper wall portion 221 and a lower wall portion 222. The lower wall portion 222 is affixed to the base 210, and the partition 230 is connected to a lower end of the upper wall portion 221. The wall 220 can further include four positioning portions 223 and four positioning holes 224. Each of the positioning portions 223 protrudes downward from the lower end of the upper wall portion 221. Each of the positioning holes 224 is located at the lower wall portion 222, and is configured to receive the positioning portion 223. After the positioning portions 223 are engaged with the positioning holes 224, the lower chamber S12 is formed by the base 210, the lower wall portion 222 and the partition 230, and the upper chamber S11 is formed by the upper wall portion 221 and the partition 230.

The case unit 200 can further include a limiting portion 250. The limiting portion 250 is located at the upper chamber S11 and connected to the partition 230. The limiting portion 250 limits the engaging unit 400. Through the configuration of the limiting portion 250, the engaging unit 400 can be limited in the upper chamber S11 and is prohibited from separating from the case unit 200. Preferably, the case unit 200 can include a through hole 260 located at the partition 230. The limiting portion 250 includes four limiting arms 251 spaced apart circumferentially around the through hole 260. Each of the limiting arms 251 has a free end 2511 configured to limit the engaging unit 400. The through hole 260 penetrating a center of the partition 230 along the axial direction I1 allows the lower chamber S12 to communicate with the upper chamber S11. The four limiting arms 251 protrude upward from a part of the partition 230, which is near the through hole 260, and form the free ends 2511 of lipped structure. Therefore, the engaging unit 400 can be put downward into the upper chamber S11 along the axial direction I1, and the four limiting arms 251 will be displaced so as to pass through a central hole (not labeled) of the engaging unit 400. After the engaging unit 400 is put into the upper chamber S11, the four limiting arms 251 are restored and the free ends 2511 limit the engaging unit 400 such that the engaging unit 400 is limited in the upper chamber S11.

The fastening device 100 can further include a spool 300 and a central shaft 600. The spool 300 is within the receiving space and includes an engaging portion 340. The central shaft 600 is inserted into the spool 300 to couple to the engaging portion 340. The central shaft 600 has the axial direction I1 and is linked up with the knob 500. When the knob 500 is in the first position to couple to the engaging unit 400, the engaging unit 400 is engaged with one of the mounting teeth 240 to prohibit the spool 300 from rotating in the first direction R1, and when the knob 500 is in the second position to disengage from the engaging unit 400, the engaging unit 400 does not prohibit the spool 300 from rotating in the first direction R1.

The spool 300 can include a hollow body 310, an upper ring portion 320 and a lower ring portion 330. The hollow body 310 includes an inner surface 311 forming a hollow space T2 configured for the central shaft 600 to inert therein. The upper ring portion 320 protrudes outward from one of two ends of the hollow body 310. The lower ring portion 330 protrudes outward from the other one of the two ends of the hollow body 310. A winding track T1 is formed between the upper ring portion 320 and the lower ring portion 330, and the engaging portion 340 protrudes from the inner surface 311 toward the hollow space T2 to couple to the central shaft 600. In addition, the central shaft 600 can include a positioning protrusion 610. When the knob 500 is in the first position, the positioning protrusion 610 is located at one of two sides of the engaging portion 340, and when the knob 500 is switched from the first position to the second position along the axial direction I1, the engaging portion 340 is displaced by the positioning protrusion 610 such that the positioning protrusion 610 is switched to the other one of the two sides of the engaging portion 340.

To be more specific, the inner surface 311 has an upper region 3112 and a lower region 3111. The upper region 3112 includes a vertical section (not labeled) and an inclined section (not labeled). The vertical section is connected to the inclined section, and the inclined section is connected to the lower region 3111. The engaging portion 340 includes four clamping arms 341, and each of the clamping arms 341 protrudes from the inclined section toward the hollow space T2 to form a clamping end 3411 of lipped structure. The central shaft 600 can further include a base portion 620 and a shaft portion 630. The shaft portion 630 is disposed at the base portion 620, and the positioning protrusion 610 is located at the shaft portion 630. Hence, the central shaft 600 can be put upward into the hollow space T2 to engage with the engaging portion 340, and the base portion 620 can be limited in the lower region 3111. The fastening device 100 can further include a screw member 700. The screw member 700 connects the central shaft 600 to the knob 500 such that the central shaft 600 is linked up with the knob 500.

When operation of the knob 500 causes the central shaft 600 to move upward along the axial direction I1, the positioning protrusion 610 pushes the four clamping arms 341 such that the four clamping arms 341 are displaced radially, and the positioning protrusion 610 can move from one of the two sides of the engaging portion 340 to the other one of the two sides of the engaging portion 340. Subsequently, the four clamping arms 341 are restored such that the knob 500 can remain in the second position.

The winding track T1 is configured for a lace (not shown) to wind thereabout. The case unit 200 can further include two lace holes 270. The two lace holes 270 are located at the lower wall portion 222, and the lace holes 270 can communicate with the lower chamber S12. Consequently, the lace can go out or drawn back into the lower chamber S12 to be released from or wound about the winding track T1 via the two lace holes 270.

The knob 500 can include a plurality of first driving teeth 540, and the engaging unit 400 can include a plurality of first combining teeth 410. When the knob 500 is in the first position, the first driving teeth 540 are engaged with the first combining teeth 410, and when the knob 500 is in the second position, the first driving teeth 540 are disengaged from the first combining teeth 410. Additionally, the knob 500 can further include a cap body 510 covering on the case unit 200, a post 520 disposed at the cap body 510 and protruding into the through hole 260, and a plurality of second driving teeth 530 located at a distal end of the post 520 to couple to the spool 300.

The cap body 510 of the knob 500 includes an inner top surface (not shown), and the post 520 protrudes downward from the inner top surface. The second driving teeth 530 are located at an outer surface of the post 520, and the first driving teeth 540 are located at the inner top surface and surround the post 520. The engaging unit 400 can include a hollow ring body 430, and the first combining teeth 410 are located at the top end of the hollow ring body 430. When the cap body 510 and the case unit 200 are assembled, the post 520 can protrude into the through hole 260 such that the second driving teeth 530 are engaged with a plurality of second combining teeth (not labeled) which are located at the upper region 3112 to allow the knob 500 to couple to the spool 300.

In the embodiment, the engaging unit 400 can further include a plurality of pawl arms 420, and each of the pawl arms 420 protrudes outward from the hollow ring body 430. Each of the pawl arms 420 is engaged with at least one of the mounting teeth 240 in the first direction R1 to prohibit the engaging unit 400 from rotating in the first direction R1. On the other hand, each of the pawl arms 420 is disengaged from the mounting teeth 240 in a second direction R2 opposite to the first direction R1, and the engaging unit 400 is allowed to rotate in the second direction R2 relative to the case unit 200.

When the knob 500 is in the first position, as shown in FIG. 4, the first driving teeth 540 of the knob 500 are engaged with the first combining teeth 410 of the engaging unit 400, and the second driving teeth 530 of the knob 500 are engaged with the second combining teeth of the spool 300 such that rotation of the knob 500 by a user in the second direction R2 causes the pawl arms 420 to disengage from the mounting teeth 240, and the spool 300 can be linked up with the knob 500 to retract the lace. On the contrary, when the knob 500 is released by the user, each of the pawl arms 420 can engage with at least one of the mounting teeth 240, and rotation of the knob 500 is limited by the engaging unit 400. Meanwhile, rotation of the spool 300 in the first direction R1 is inhibited, and the lace is fastened.

When the user is looking forward to release the lace, as shown in FIG. 5, the knob 500 can be raised along the axial direction I1. The first driving teeth 540 of the knob 500 are disengaged from the first combining teeth 410 of the engaging unit 400, and the second driving teeth 530 of the knob 500 are disengaged from the second combining teeth of the spool 300. As a result, rotation of the knob 500 and the spool 300 are not inhibited by the engaging unit 400. In other embodiment, when the knob is in the second position, the engagement between the second driving teeth of the knob and the second combining teeth of the spool can be remained, but the present disclosure is not limited thereto.

Figure 6:
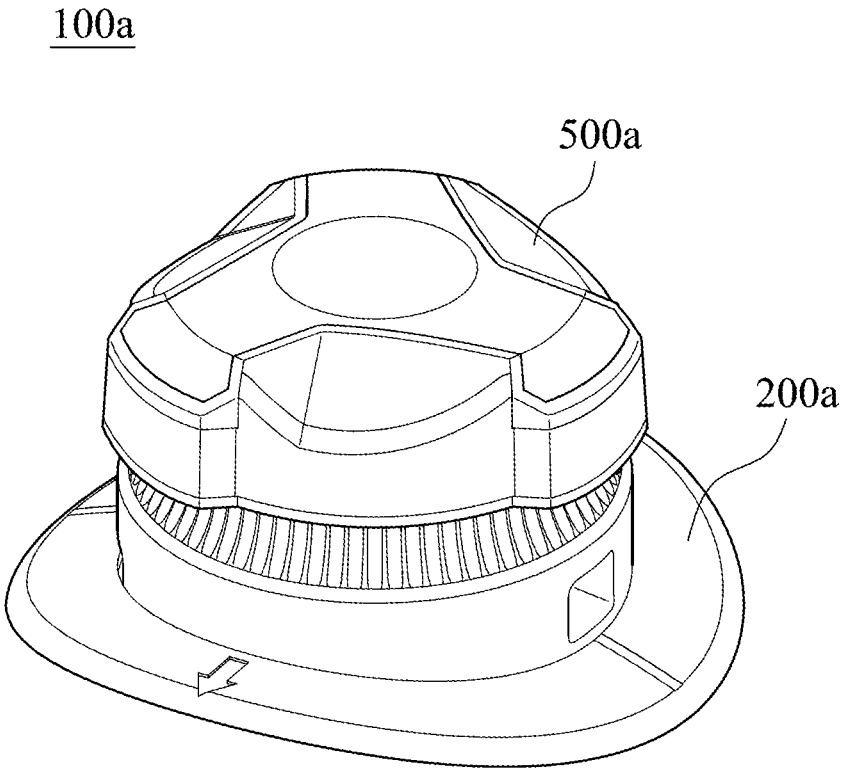
FIG. 6 shows a three dimensional schematic view of a fastening device according to a second embodiment of the present disclosure.
Figure 7:
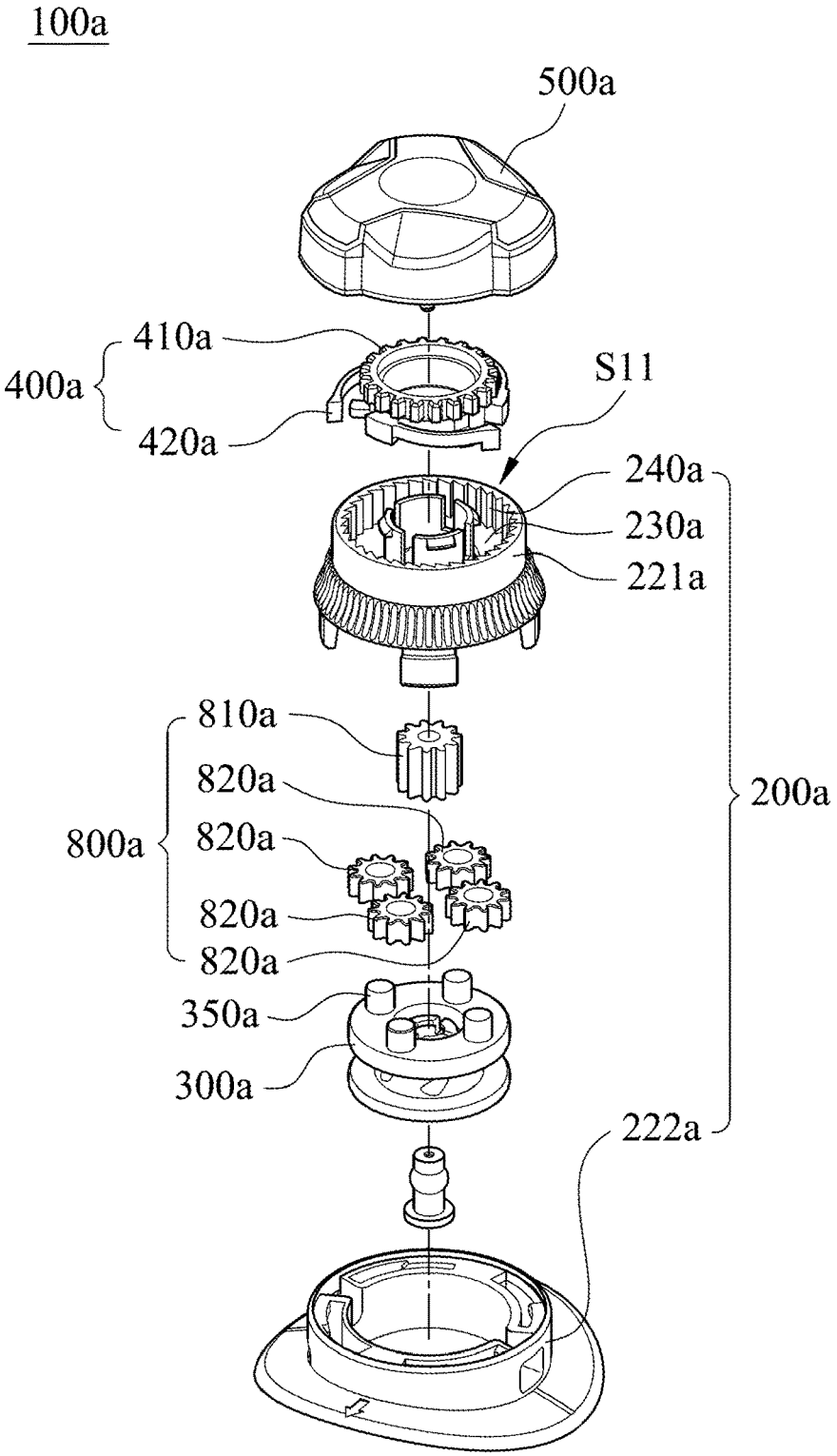
FIG. 7 shows one exploded view of the fastening device of FIG. 6.
Figure 8:
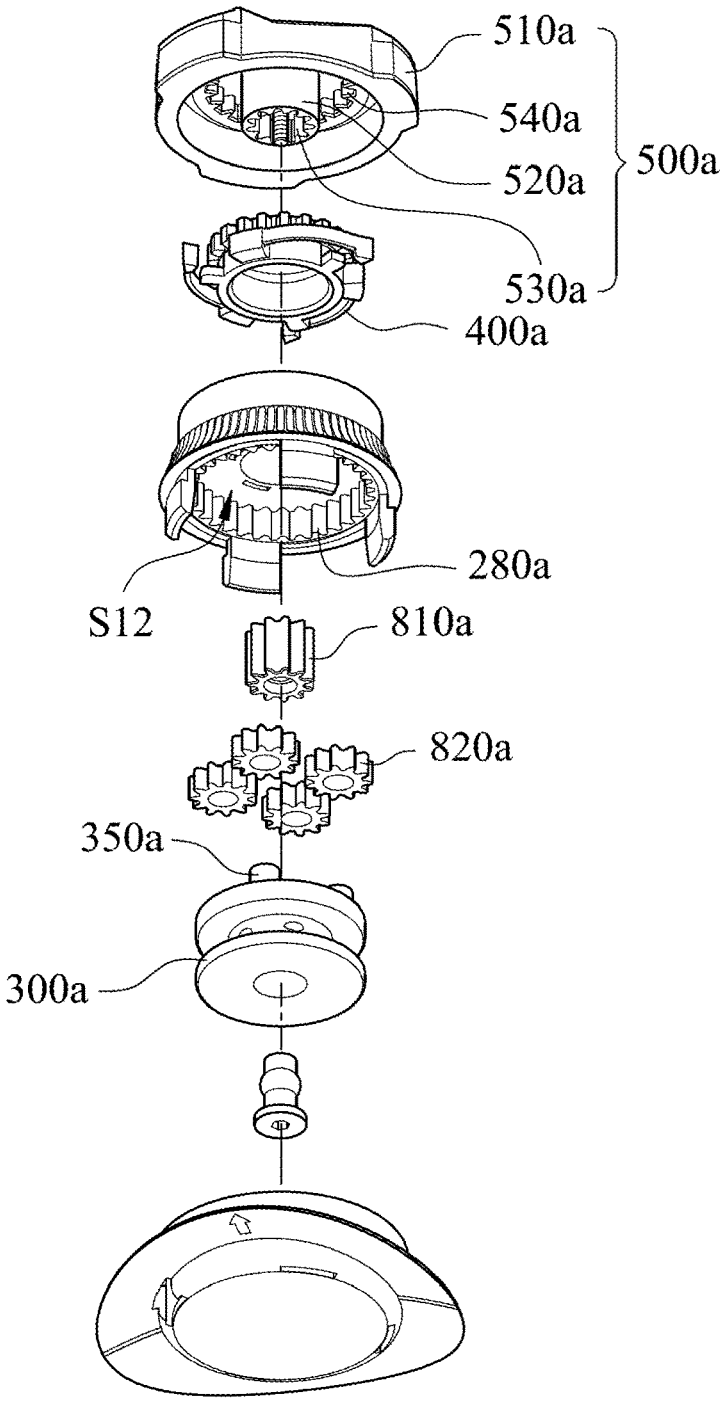
FIG. 8 shows another exploded view of the fastening device of FIG. 6.
Figure 9:
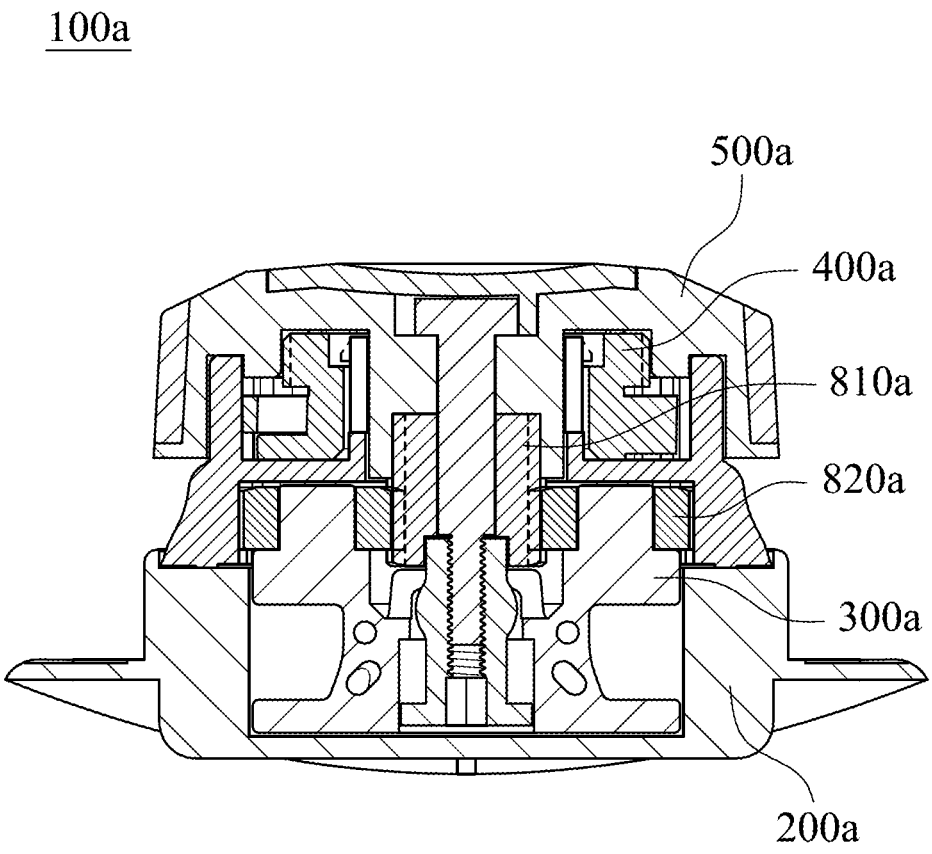
FIG. 9 shows one cross-sectional view of the fastening device of FIG. 6.
Figure 10:
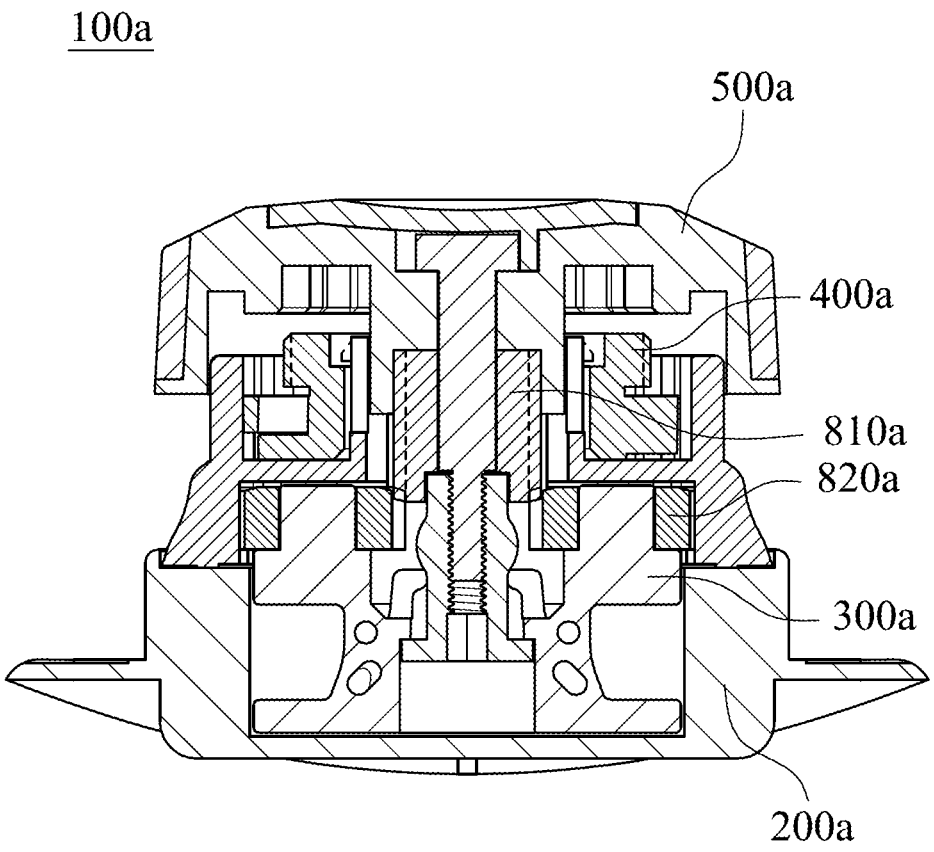
FIG. 10 shows another cross-sectional view of the fastening device of FIG. 6.

FIG. 6 shows a three dimensional schematic view of a fastening device 100*a* according to a second embodiment of the present disclosure. FIG. 7 shows one exploded view of the fastening device 100*a* of FIG. 6. FIG. 8 shows another exploded view of the fastening device 100*a* of FIG. 6. FIG. 9 shows one cross-sectional view of the fastening device 100*a* of FIG. 6. FIG. 10 shows another cross-sectional view of the fastening device 100*a* of FIG. 6. The structure of the fastening device 100*a* is similar to the structure of the fastening device 100, but the spool 300*a* is coupled to the knob 500*a* in a different way.

To be more specific, the knob 500*a* can further include a cap body 510*a*, a post 520*a* and a plurality of second driving teeth 530*a*. The cap body 510*a* covers on the case unit 200*a*. The post 520*a* is disposed at the cap body 510*a* and protrudes into the through hole (not labeled), and the second driving teeth 530*a* are located at a distal end of the post 520*a*. The fastening device 100*a* further includes a gear assembly 800*a*, and the gear assembly 800*a* includes a sun gear 810*a* and a plurality of planetary gears 820*a*. The sun gear 810*a* is engaged with the second driving teeth 530*a*. A number of the planetary gears 820*a* is four in the embodiment, and the planetary gears 820*a* are spaced away from each other. Each of the planetary gears 820*a* is engaged with the sun gear 810*a*. The case unit 200*a* can further include a plurality of inner teeth 280*a* located at the lower chamber S12 and engaged with the planetary gears 820*a*.

The post 520*a* include a cave (not labeled) located at the distal end. The second driving teeth 530*a* are located within the cave. The sun gear 810*a* is engaged with the cave to engage with the second driving teeth 530*a*. The spool 300*a* includes four pivotal shafts 350*a* configured for the planetary gears 820*a* to be pivoted thereon. The partition 230*a* protrudes inwardly from a middle part of the upper wall portion 221*a*. The upper wall portion 221*a* can be deemed to be separated by the partition 230*a* such that the upper chamber S11 can be formed by the upper section of the upper wall portion 221*a*, and the lower chamber S12 can be formed by the lower section of the upper wall portion 221*a*, the lower wall portion 222*a* and the base (not labeled). The inner teeth 280*a* can be disposed within the lower section of the upper wall portion 221*a*. When the knob 500*a* is rotated, the sun gear 810*a* is driven by the second driving teeth 530*a*, and the planetary gears 820*a* will rotate and move along the inner teeth 280*a* to rotate the spool 300*a*.

Therefore, as shown in FIG. 9, when the knob 500*a* is in the first position, the first driving teeth 540*a* of the knob 500*a* are engaged with the first combining teeth 410*a* of the engaging unit 400*a*, and the second driving teeth 530*a* of the knob 500*a* are engaged with the gear assembly 800*a* such that rotation of the knob 500*a* by a user in a second direction causes the pawl arms 420*a* to disengage from the mounting teeth 240*a*, and the spool 300*a* can be linked up with the knob 500*a* to retract the lace. On the contrary, when the knob 500*a* is released by the user, each of the pawl arms 420*a* can be engaged with at least one of the mounting teeth 240*a*, and rotation of the knob 500*a* is limited by the engaging unit 400*a*. Meanwhile, rotation of the spool 300*a* in the first direction is inhibited, and the lace is fastened.

When the user is looking forward to release the lace, as shown in FIG. 10, the knob 500*a* can be raised along the axial direction. The first driving teeth 540*a* of the knob 500*a* are disengaged from the first combining teeth 410*a* of the engaging unit 400*a*, and rotation of the knob 500*a* and the spool 300*a* are not inhibited by the engaging unit 400*a*. Since the sun gear 810*a* is still coupled to the planetary gears 820*a*, the knob 500*a* is still coupled to the spool 300*a*.

Figure 11:
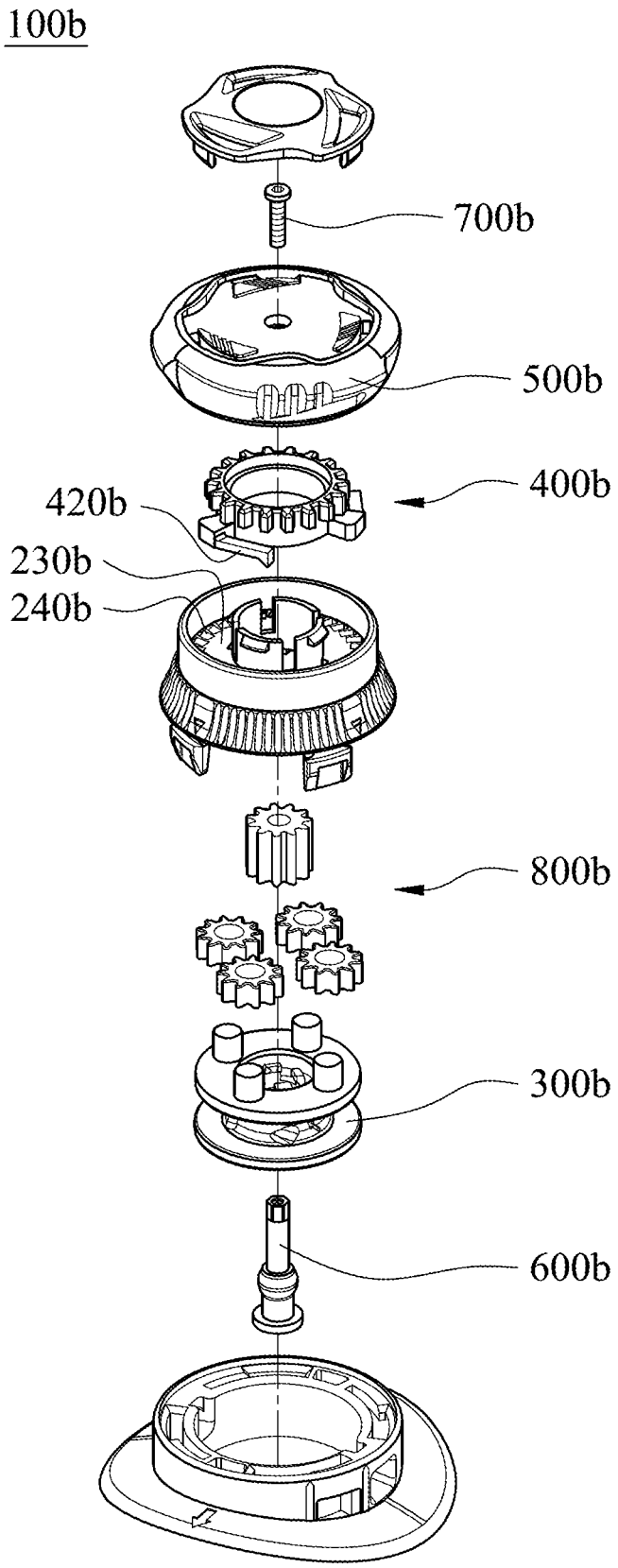
FIG. 11 shows one exploded view of a fastening device according to a third embodiment of the present disclosure.
Figure 12:
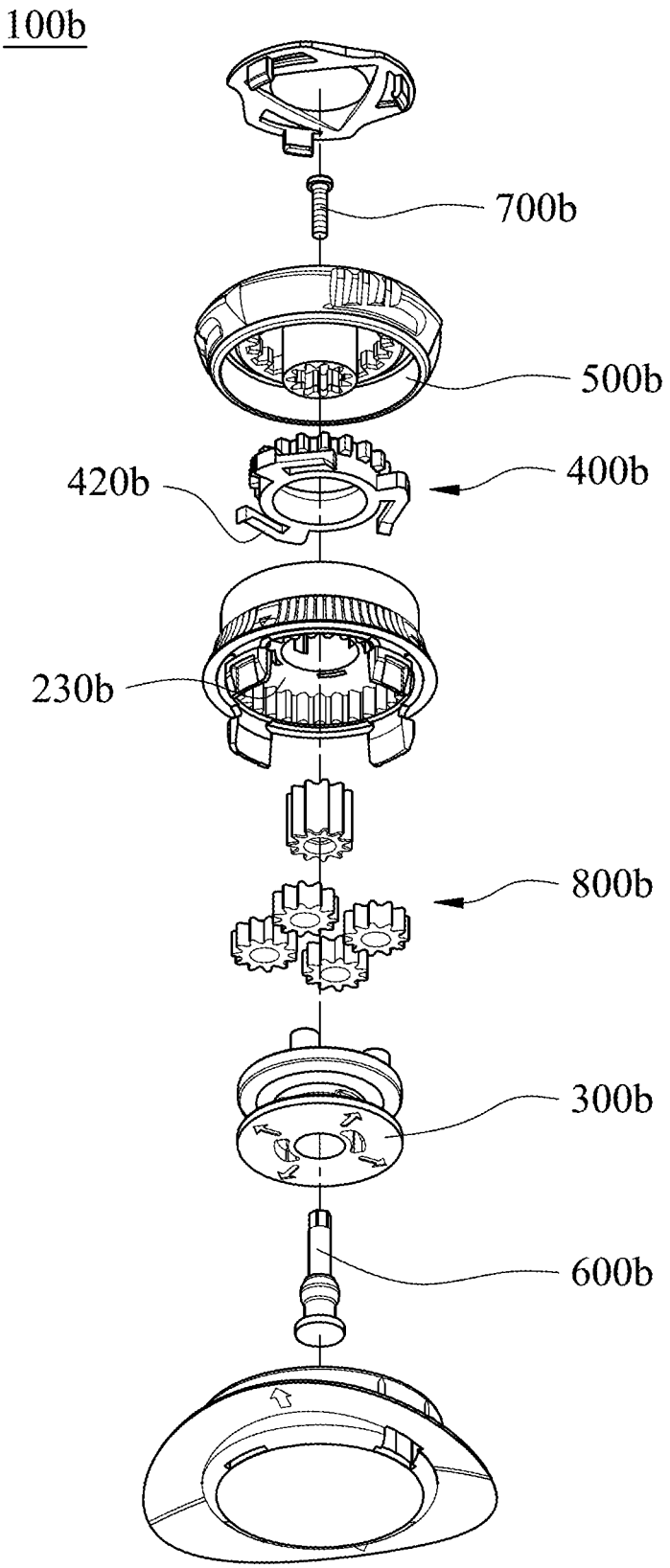
FIG. 12 shows another exploded view of the fastening device of FIG. 11.
Figure 13:
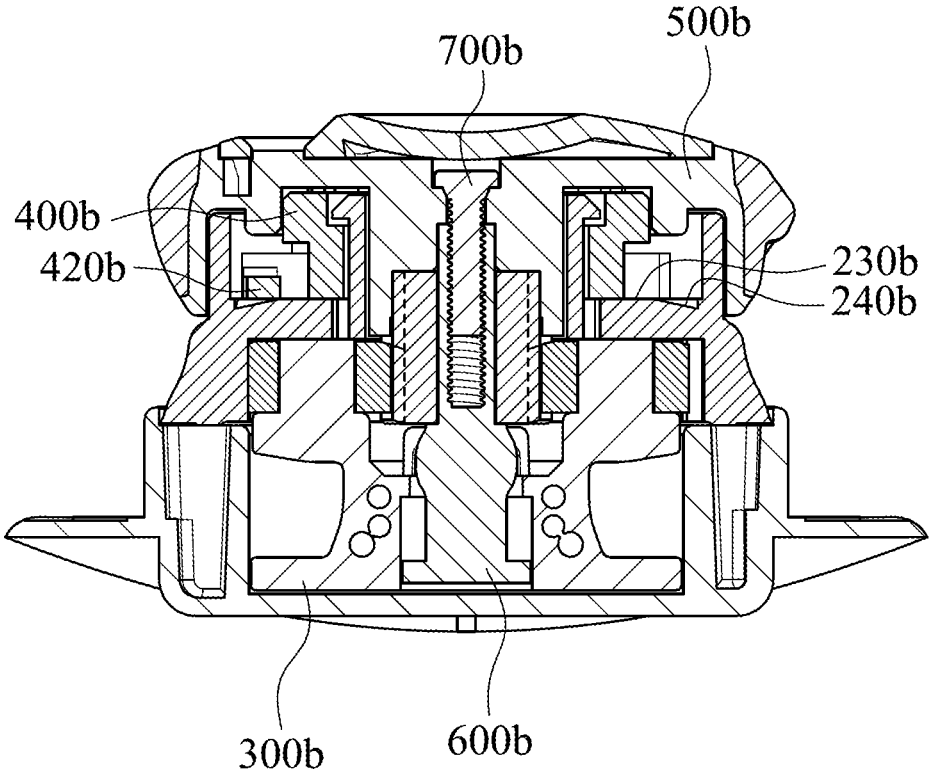
FIG. 13 shows a cross-sectional view of the fastening device of FIG. 11.

FIG. 11 shows one exploded view of a fastening device 100*b* according to a third embodiment of the present disclosure. FIG. 12 shows another exploded view of the fastening device 100*b* of FIG. 11. FIG. 13 shows a cross-sectional view of the fastening device 100*b* of FIG. 11. Please refer to FIGS. 11 to 13, the fastening device 100*b* includes a base unit (not labeled), a spool 300*b*, an engaging unit 400*b*, a knob 500*b*, a central shaft 600*b*, a screw member 700*b* and a gear assembly 800*b*. The structure of the fastening device 100*b* is similar to the structure of the fastening device 100*a*, but the mounting teeth 240*b* are located on the partition 230*b*. Moreover, the paw tooth of the pawl arm 420*b* is protruded downward to correspond to the mounting teeth 240*b*.

Therefore, as shown in FIG. 13, when the knob 500*b* is in the first position, rotation of the knob 500*b* by a user in a second direction causes the engaging unit 400*b* to rotate such that the pawl arms 420*b* are disengaged from the mounting teeth 240*b*, and the spool 300*b* can be linked with the knob 500*b* to retract the lace. When the user is looking forward to release the lace, the knob 500*b* can be raised along the axial direction to the second position. The knob 500*b* separates from the engaging unit 400*b* while the pawl arms 420*b* are still in the original position to engage with the mounting teeth 240*b*, and rotation of the knob 500*b* and the spool 300*b* are not inhibited by the engaging unit 400*b*.

Figure 14:
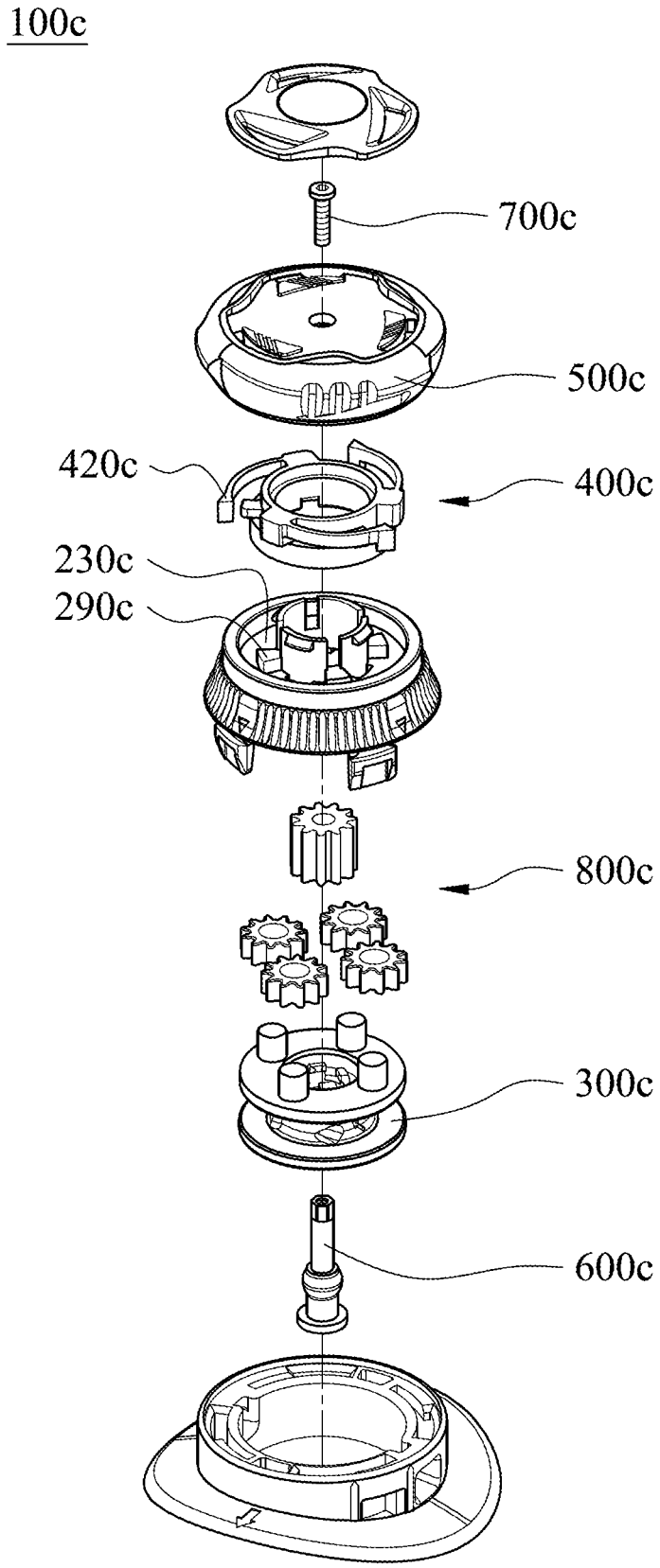
FIG. 14 shows one exploded view of a fastening device according to a forth embodiment of the present disclosure.
Figure 15:
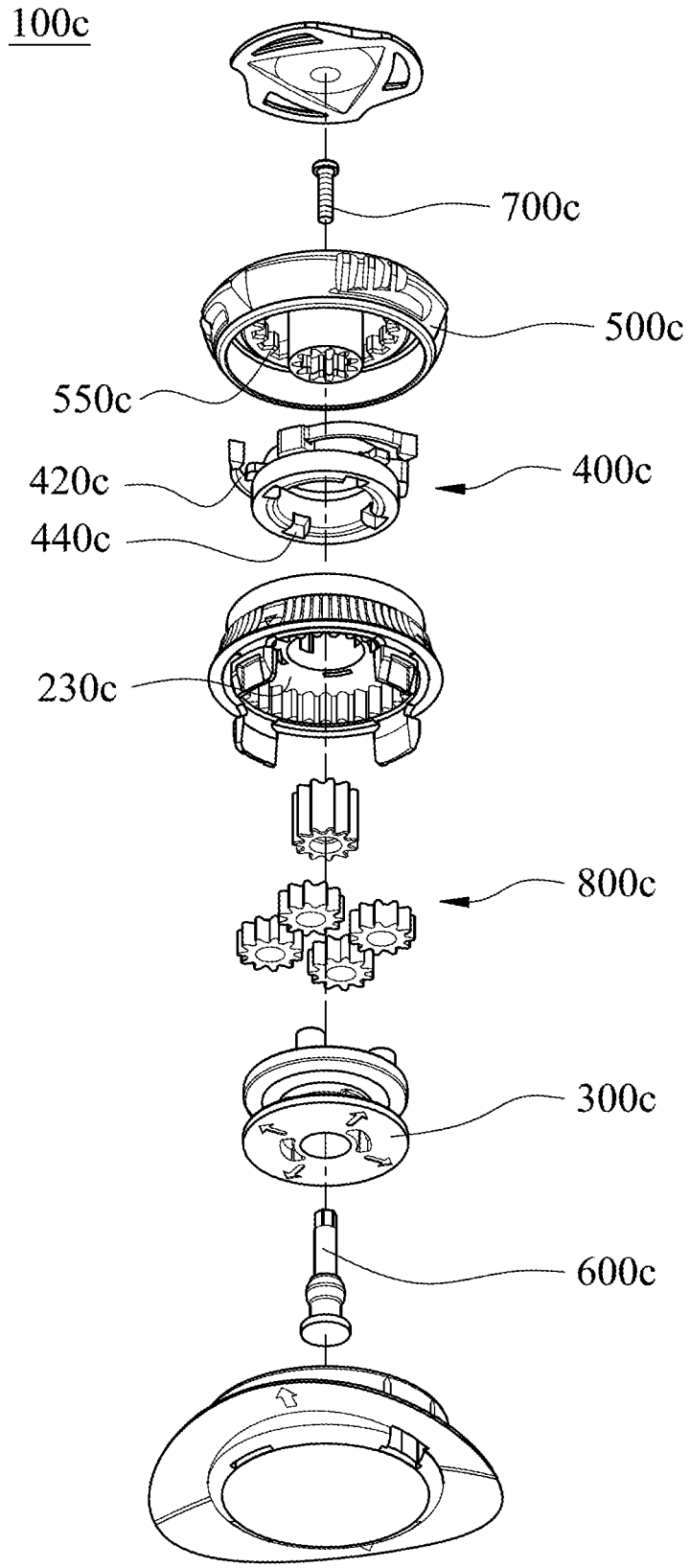
FIG. 15 shows another exploded view of the fastening device of FIG. 14.
Figure 16:
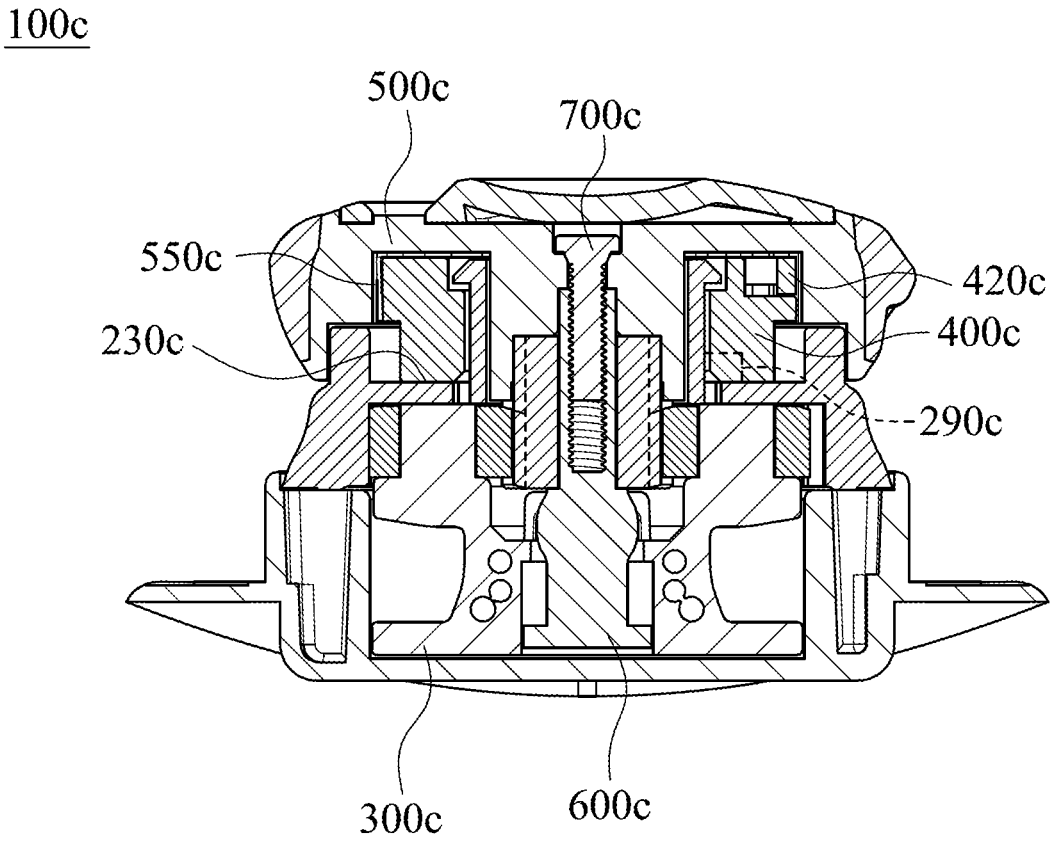
FIG. 16 shows a cross-sectional view of the fastening device of FIG. 14.

FIG. 14 shows one exploded view of a fastening device 100*c* according to a forth embodiment of the present disclosure. FIG. 15 shows another exploded view of the fastening device 100*c* of FIG. 14. FIG. 16 shows a cross-sectional view of the fastening device 100*c* of FIG. 14. Please refer to FIGS. 14 to 16, the fastening device 100*c* includes a base unit (not labeled), a spool 300*c*, an engaging unit 400*c*, a knob 500*c*, a central shaft 600*c*, a screw member 700*c* and a gear assembly 800*c*. The structure of the fastening device 100*c* is similar to the structure of the fastening device 100*a*, but the mounting teeth 550*c* are located on the knob 500*c*. Moreover, the structure of the engaging unit 400*c* is different, and a plurality of engaging protrusions 290*c* are located on the partition 230*c*.

Precisely, the knob 500*c* can further include a cap body (not labeled), and the mounting teeth 550*c* are located at the annular side wall of the cap body. The pawl arms 420*c* are located on the upper side of the hollow ring body (not labeled) to correspond to the mounting teeth 550*c*, and the engaging unit 400*c* further includes a plurality of engaging cavities 440*c* located on the lower side of the hollow ring body to engage with the engaging protrusions 290*c*. Under such structure, the engaging unit 400*c* is not rotatable.

Therefore, as shown in FIG. 16, when the knob 500*c* is in the first position, rotation of the knob 500*c* by a user in a second direction causes the mounting teeth 550*c* to disengage from the pawl arms 420*c*, and the spool 300*c* can be linked with the knob 500*c* to retract the lace. When the user is looking forward to release the lace, the knob 500*c* can be raised along the axial direction to the second position. The knob 500*c* separates from the engaging unit 400*c* such that the mounting teeth 550*c* are separated from the engaging unit 400*c* which is still in the original position, and rotation of the knob 500*c* and the spool 300*c* are not inhibited by the engaging unit 400*c*.

Figure 17:
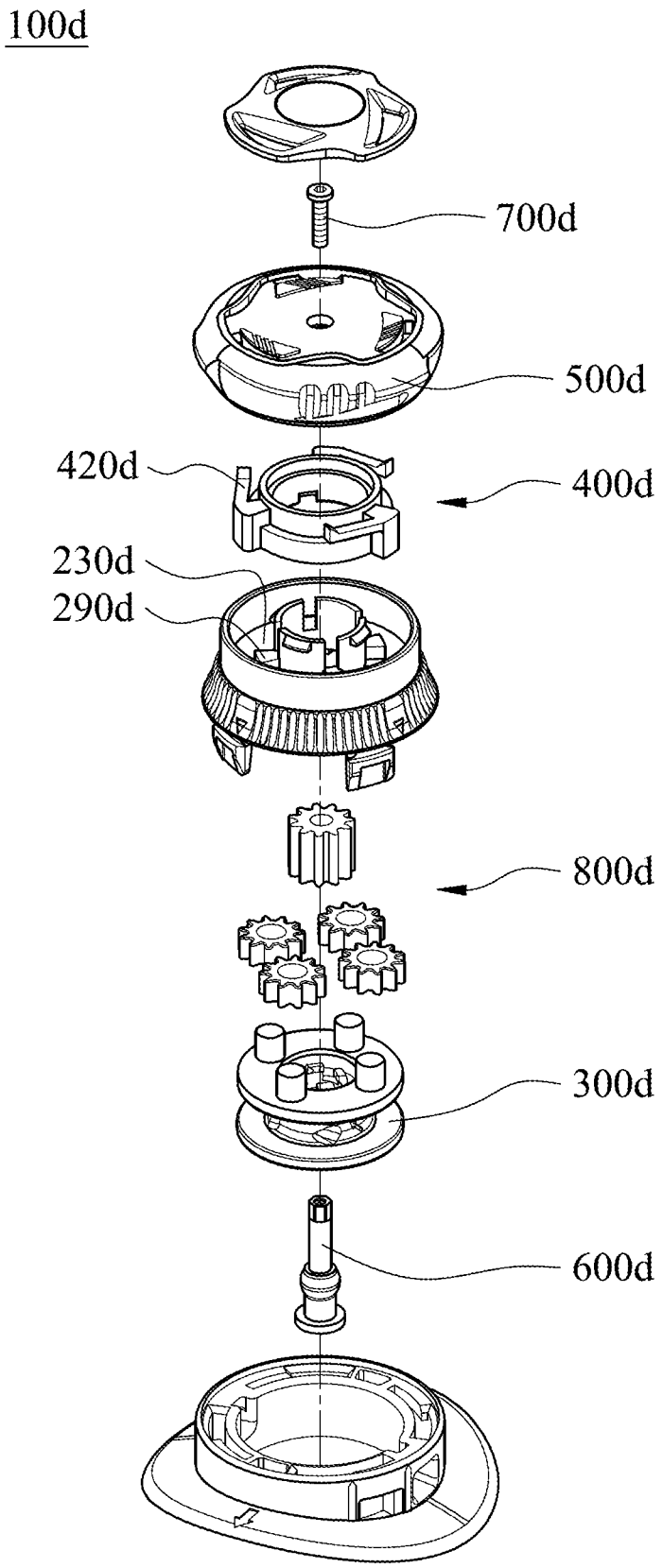
FIG. 17 shows one exploded view of a fastening device according to a fifth embodiment of the present disclosure.
Figure 18:
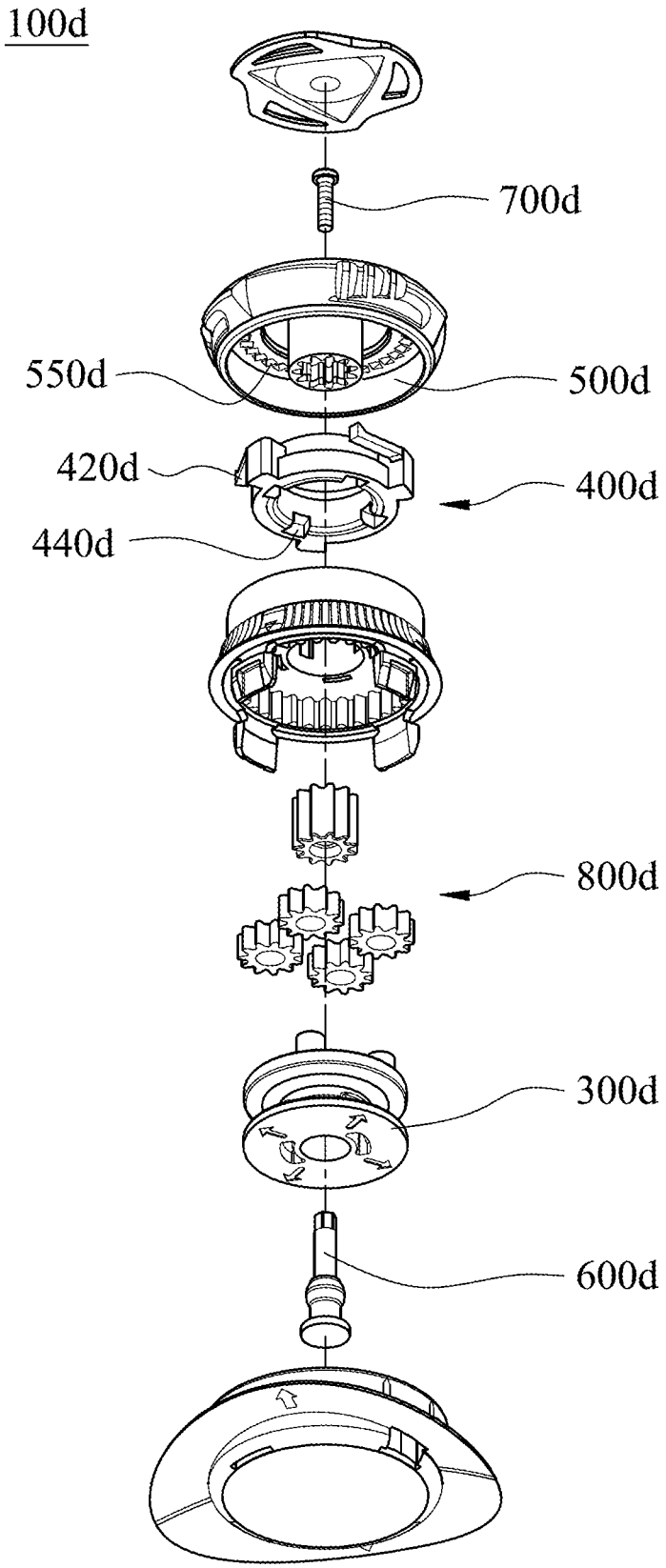
FIG. 18 shows another exploded view of the fastening device of FIG. 17.
Figure 19:
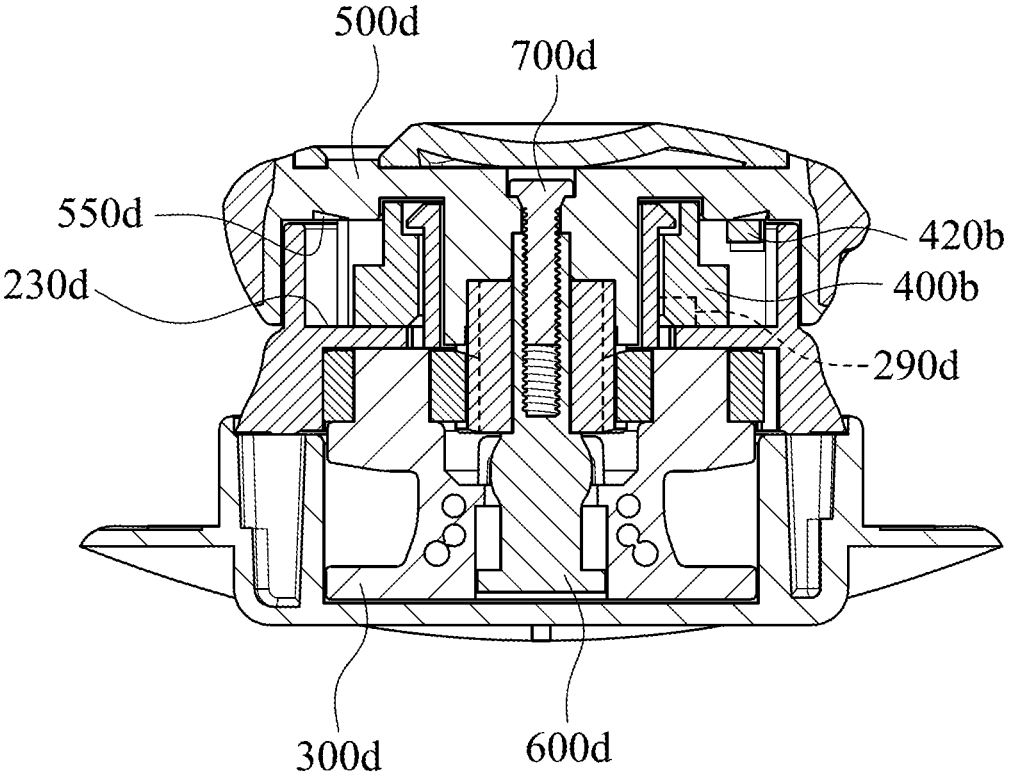
FIG. 19 shows a cross-sectional view of the fastening device of FIG. 17.

FIG. 17 shows one exploded view of a fastening device 100*d* according to a fifth embodiment of the present disclosure. FIG. 18 shows another exploded view of the fastening device 100*d* of FIG. 17. FIG. 19 shows a cross-sectional view of the fastening device 100*d* of FIG. 17. Please refer to FIGS. 17 to 19, the fastening device 100*d* includes a base unit (not labeled), a spool 300*d*, an engaging unit 400*d*, a knob 500*d*, a central shaft 600*d*, a screw member 700*d* and a gear assembly 800*d*. The structure of the fastening device 100*d* is similar to the structure of the fastening device 100*c*, and a plurality of engaging protrusions 290*d* are located on the partition 230*d* to correspond to a plurality of engaging cavities 440*d* of the engaging unit 400*d*, but the mounting teeth 550*d* are located on the top surface of the cap body (not labeled) of the knob 500*d*. Moreover, the paw tooth of the pawl arm 420*d* is protruded upward to correspond to the mounting teeth 550*d*.

Therefore, as shown in FIG. 19, when the knob 500*d* is in the first position, rotation of the knob 500*d* by a user in a second direction causes the mounting teeth 550*d* to disengage from the pawl arms 420*d*, and the spool 300*d* can be linked with the knob 500*d* to retract the lace. When the user is looking forward to release the lace, the knob 500*d* can be raised along the axial direction to a second position. The knob 500*d* separates from the engaging unit 400*d* such that the mounting teeth 550*d* are separated from the engaging unit 400*d* which is still in the original position, and rotation of the knob 500*d* and the spool 300*d* are not inhibited by the engaging unit 400*d*.

Figure 20:
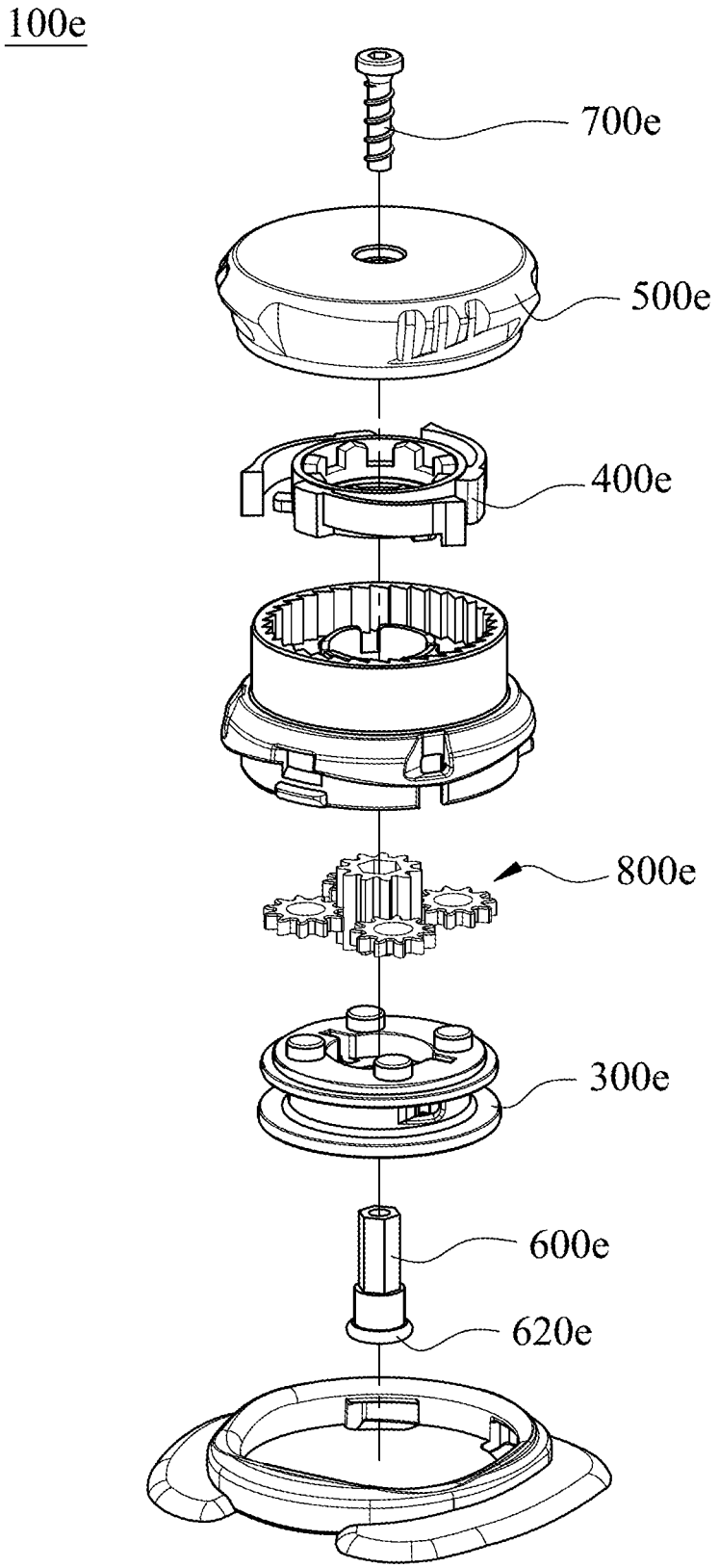
FIG. 20 shows one exploded view of a fastening device according to a sixth embodiment of the present disclosure.
Figure 21:
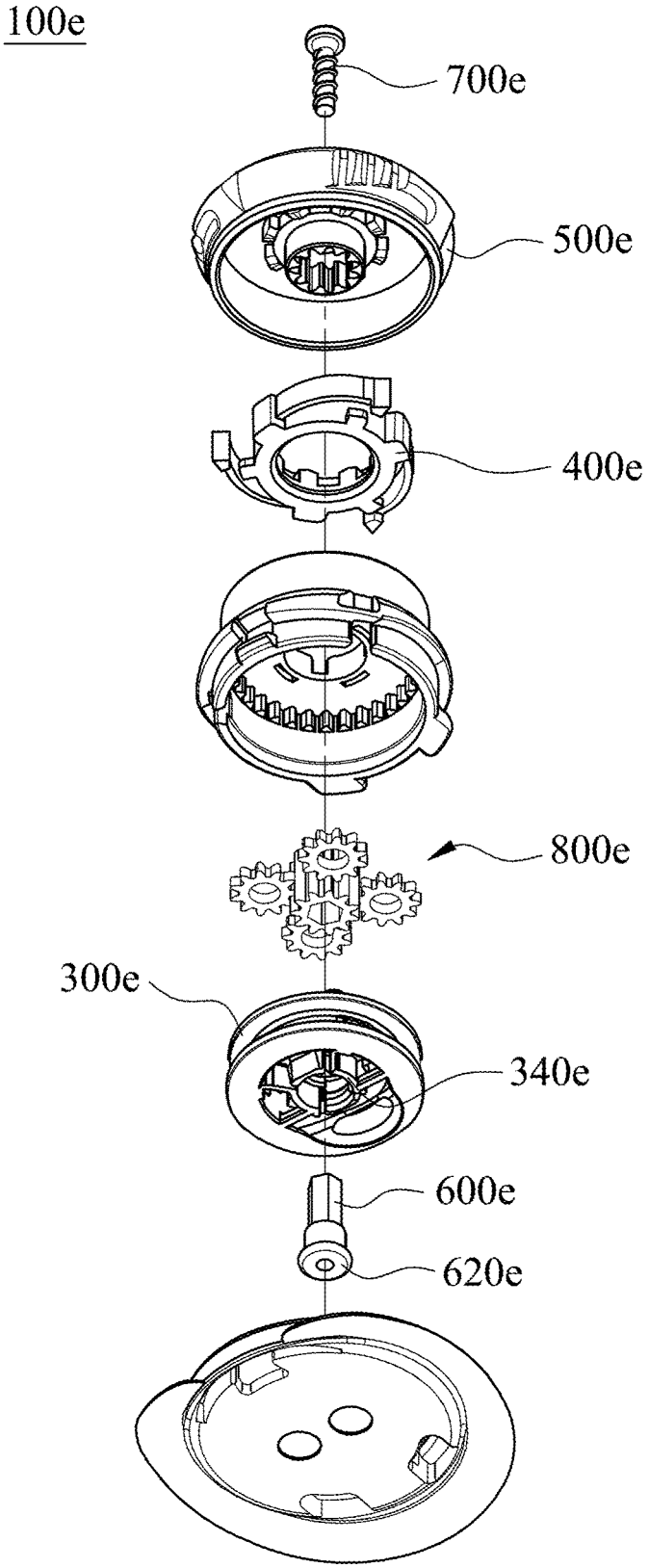
FIG. 21 shows another exploded view of the fastening device of FIG. 20.
Figure 22:
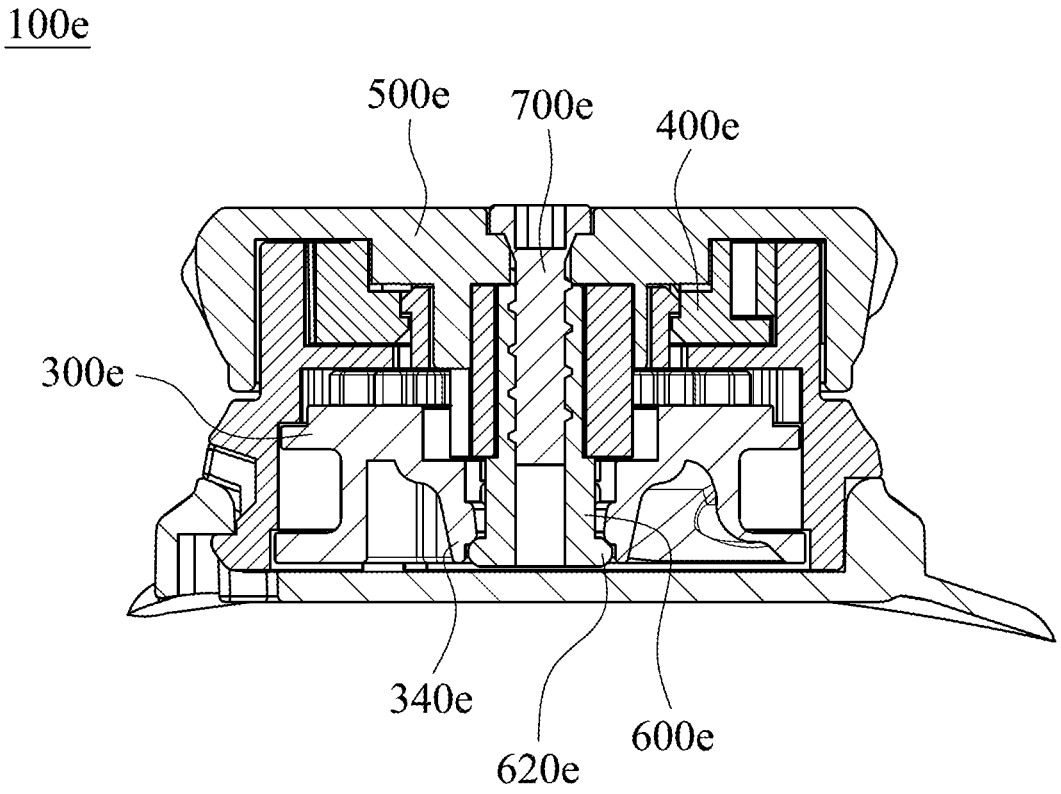
FIG. 22 shows a cross-sectional view of the fastening device of FIG. 20.

FIG. 20 shows one exploded view of a fastening device 100*e* according to a sixth embodiment of the present disclosure. FIG. 21 shows another exploded view of the fastening device 100*e* of FIG. 20. FIG. 22 shows a cross-sectional view of the fastening device 100*e* of FIG. 20. Please refer to FIGS. 20 to 22, the fastening device 100*e* includes a base unit (not labeled), a spool 300*e*, an engaging unit 400*e*, a knob 500*e*, a central shaft 600*e*, a screw member 700*e* and a gear assembly 800*e*. The structure of the fastening device 100*e* is similar to the structure of the fastening device 100*a*, but the spool 300*e* is different. Precisely, the spool 300*e* includes two engaging portions 340*e* protruding downward, and a free end of each of the engaging portions 340*e* is engaged with the base portion 620*e* of the central shaft 600*e*.

Therefore, as shown in FIG. 22, when the knob 500*e* is in the first position, the base portion 620*e* is located in the lower side of a projection of each of the engaging portions 340*e*. When the user is looking forward to release the lace, the knob 500*e* can be raised along the axial direction to a second position, and the base portion 620*e* is switched to the upper side of the projection of each of the engaging portions 340*e*.

Figure 23:
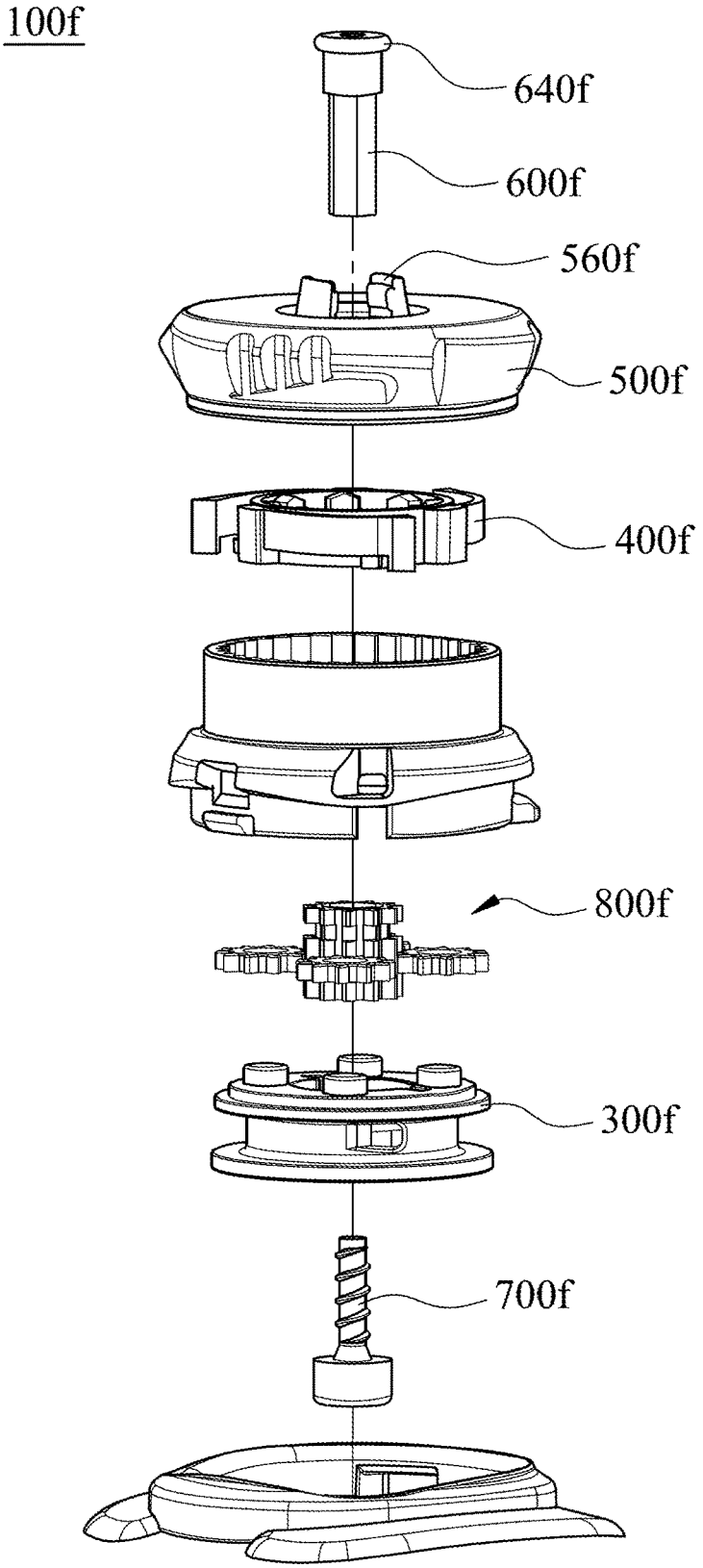
FIG. 23 shows one exploded view of a fastening device according to a seventh embodiment of the present disclosure.
Figure 24:
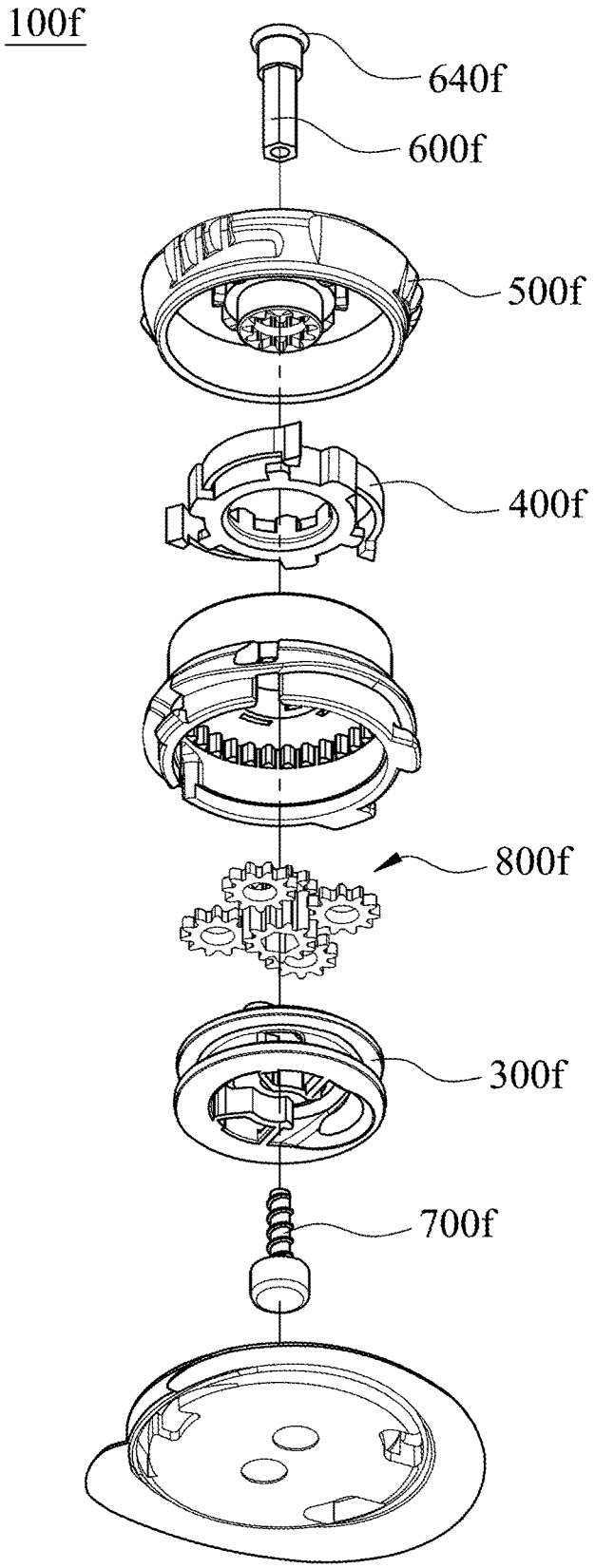
FIG. 24 shows another exploded view of the fastening device of FIG. 23.
Figure 25:
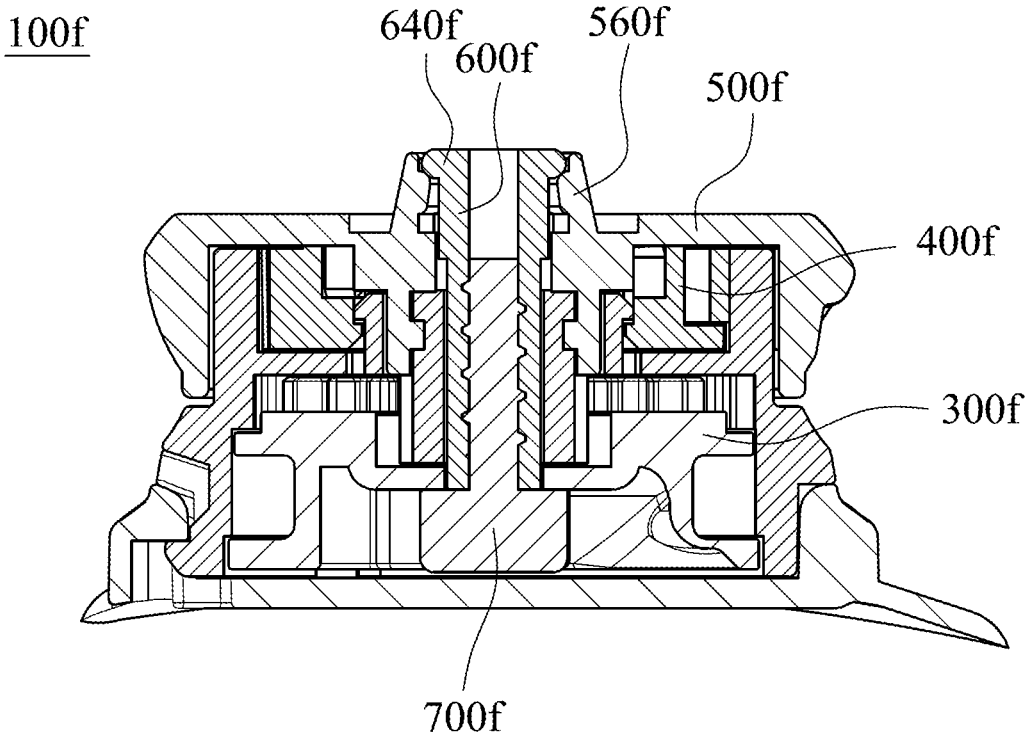
FIG. 25 shows a cross-sectional view of the fastening device of FIG. 23.

FIG. 23 shows one exploded view of a fastening device 100*f* according to a seventh embodiment of the present disclosure. FIG. 24 shows another exploded view of the fastening device 100*f* of FIG. 23. FIG. 25 shows a cross-sectional view of the fastening device 100*f* of FIG. 23. Please refer to FIGS. 23 to 25, the fastening device 100*f* includes a base unit (not labeled), a spool 300*f*, an engaging unit 400*f*, a knob 500*f*, a central shaft 600*f*, a screw member 700*f* and a gear assembly 800*f*, and the difference will be mentioned hereinafter. Precisely, the spool 300*f* does not include the two engaging portions 340*e* as shown in FIG. 21, and, instead, the knob 500*f* includes two engaging portions 560*f* protruding upward. The central shaft 600*f* is inserted downward into the knob 500*f* and includes an engaging head 640*f* for coupling with the engaging portions 560*f*. The screw member 700*f* is inserted upward from the spool 300*e* to couple to the central shaft 600*f*.

Therefore, as shown in FIG. 25, when the knob 500*f* is in the first position, the engaging head 640*f* is located in the upper side of a projection of each of the engaging portions 560*f*. When the user is looking forward to release the lace, the knob 500*f* can be raised along the axial direction to a second position, and the engaging head 640*f* is switched to the lower side of the projection of each of the engaging portions 560*f*.

Figure 26:
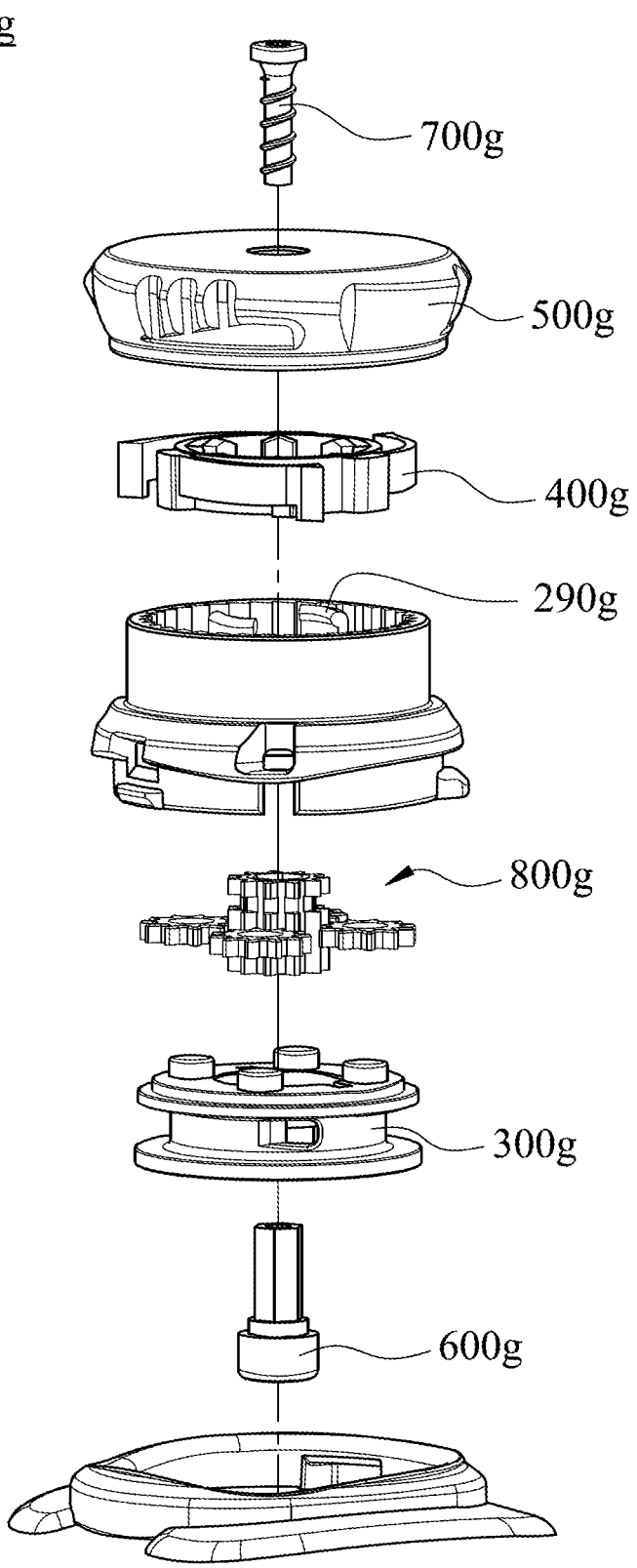
FIG. 26 shows one exploded view of a fastening device according to an eighth embodiment of the present disclosure.
Figure 27:
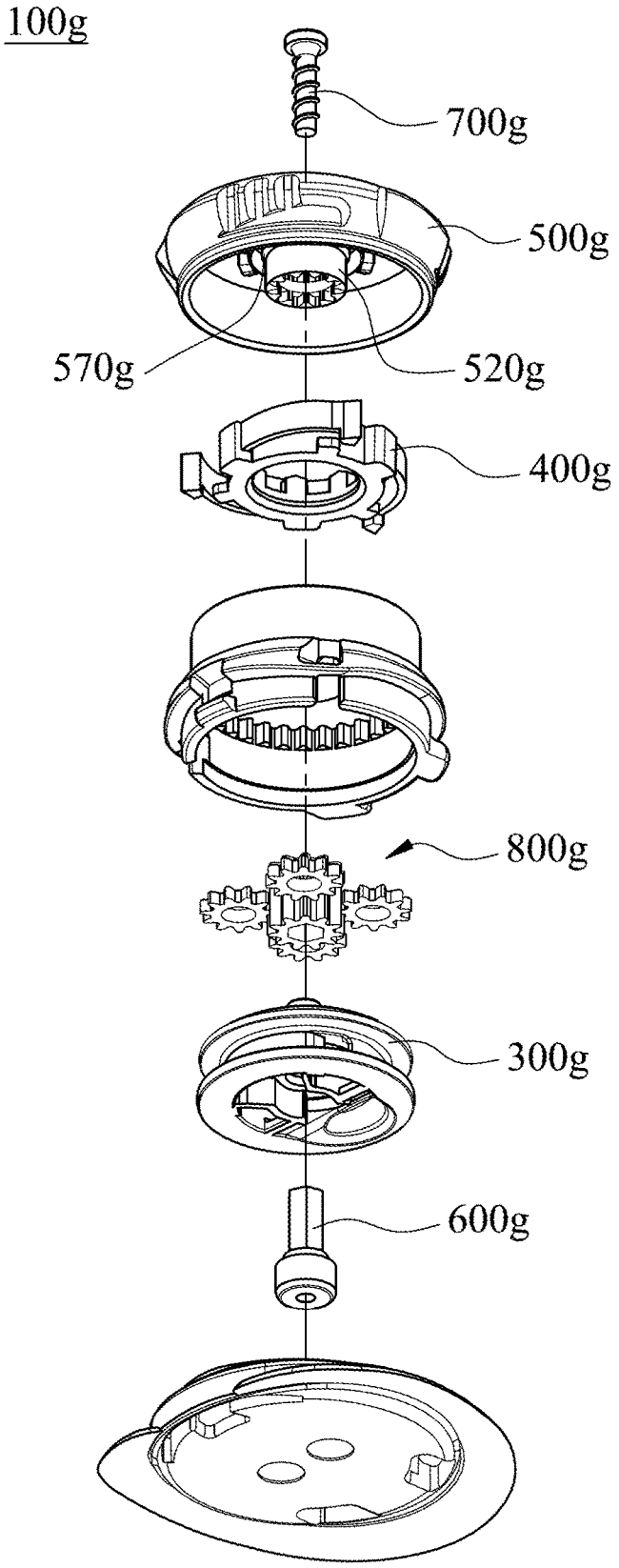
FIG. 27 shows another exploded view of the fastening device of FIG. 26.
Figure 28:
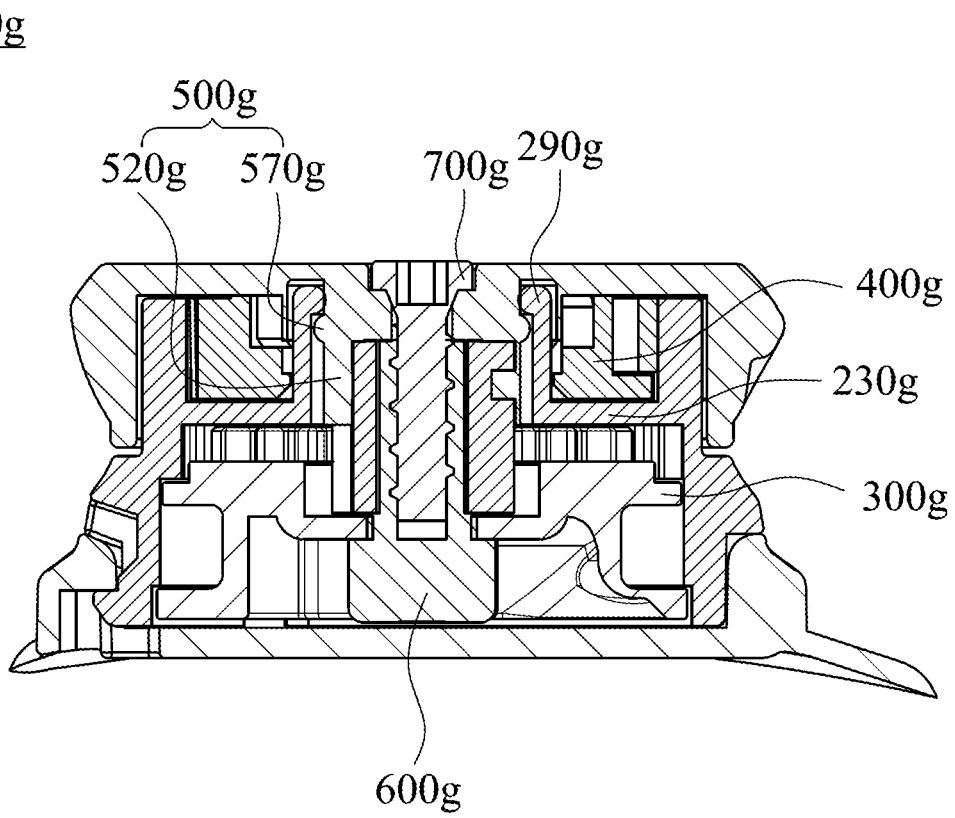
FIG. 28 shows a cross-sectional view of the fastening device of FIG. 26.

FIG. 26 shows one exploded view of a fastening device 100*g* according to an eighth embodiment of the present disclosure. FIG. 27 shows another exploded view of the fastening device 100*g* of FIG. 26. FIG. 28 shows a cross-sectional view of the fastening device 100*g* of FIG. 26. Please refer to FIGS. 26 to 28, the fastening device 100*g* includes a base unit (not labeled), a spool 300*g*, an engaging unit 400*g*, a knob 500*g*, a central shaft 600*g*, a screw member 700*g* and a gear assembly 800*g*. The structure of the fastening device 100*g* is similar to the structure of the fastening device 100*e*, and the difference will be mentioned hereinafter. The spool 300*g* does not include the two engaging portions 340*e* as shown in FIG. 21, and, instead, two engaging portions 290*g* are protruded upward form the partition 230*g*. The knob 500*g* includes a post 520*g* and a positioning ring 570*g*, and the positioning ring 570*g* is located on the post 520*g* for coupling with the two free ends of the engaging portions 290*g*.

Therefore, as shown in FIG. 28, when the knob 500*g* is in the first position, the positioning ring 570*g* is located in the lower side of the engaging portions 290*g*. When the user is looking forward to release the lace, the knob 500*g* can be raised along the axial direction to a second position, and the positioning ring 570*g* is switched to the upper side of the engaging portions 290*g*.

Please be noted that, in the present disclosure, the knob can include the cap body, a central hole and a covering member. The central hole is located on the cap body configured for the screw member to pass therethrough to fasten with the central shaft, and the covering member is assembled to the cap body to cover the screw member. Only in FIGS. 11-12, 14-15 and 17-18, the covering member is shown in a manner that separates from the cap body, and the present disclosure is not limited there to.

To sum up, the fastening device can include a case unit, a spool, a connecting unit, a knob and an engaging unit. The case unit can include a wall forming a receiving space, a partition protruding radially from the wall to separate the receiving space into an upper chamber and a lower chamber, a through hole located at the partition and a base detachably connected to at least one part of the wall, as the base 210 is affixed to a lower wall portion 222 of the wall 220 and detachably connected to an upper wall portion 221 of the wall 220 as shown in FIGS. 2 and 3. The spool is located at the lower chamber. The connecting unit is inserted into the spool. The knob covers on the case unit and is connected to the connecting unit. The engaging unit is located at the upper chamber. Because the spool is located at the lower chamber and is below the partition, and the engaging unit and the knob are located above the partition, after the connecting unit is inserted into the spool, the through hole and the engaging unit to couple to the knob, the engaging unit can be hold between the partition and the knob. Hence, the partition, the spool, the connecting unit, the knob and the engaging unit can be connected integrally without being separated from each other while the base is separated from the at least one part of the wall. The connecting unit can include the central shaft and the screw member. The central shaft can be inserted form the spool and be coupled to the engaging portion of the spool, or the central shaft can be inserted form the knob and be coupled to the engaging portion of the knob. Moreover, the knob can be coupled to the engaging portion protruding from the partition. In other words, since the engaging portion is disposed on the spool, the partition or the knob but not the base, even without the base, the partition, the spool, the connecting unit, the knob and the engaging unit can still be firmly connected.

In addition, the mounting teeth can be located on the wall, the partition, the annular side wall or the top surface of the cap body of the knob, and the pawl tooth of the pawl arm can be modified to correspond to the mounting teeth.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure covers modifications and variations of this disclosure provided they fall within the scope of the following claims.

What is claimed is:

1. A fastening device, comprising:

a case unit, comprising:

a wall forming a receiving space;

a partition protruding radially from the wall to separate the receiving space into an upper chamber and a lower chamber;

a through hole located at the partition; and a base detachably connected to at least one part of the wall;

a spool located at the lower chamber;

a connecting unit inserted into the spool;

a knob covering on the case unit and being connected to the connecting unit; and an engaging unit located at the upper chamber;

wherein after the connecting unit is inserted into the spool, the through hole and the engaging unit to couple to the knob, the partition, the spool, the connecting unit, the knob and the engaging unit are connected integrally without being separated from each other while the base is separated from the at least one part of the wall.

2. The fastening device of claim 1, wherein the spool comprises an engaging portion, and the connecting unit comprises a central shaft coupled to the engaging portion.

3. The fastening device of claim 2, wherein the spool further comprises:

a hollow body, comprising an inner surface forming a hollow space, wherein the hollow space is configured for the central shaft to insert therein;

an upper ring portion protruding outward from one of two ends of the hollow body; and a lower ring portion protruding outward from the other one of the two ends of the hollow body;

wherein a winding track is formed between the upper ring portion and the lower ring portion, and the engaging portion protrudes from the inner surface toward the hollow space to couple to the central shaft.

4. The fastening device of claim 3, wherein the central shaft comprises a positioning protrusion, when the knob is in a first position, the positioning protrusion is located at one of two sides of the engaging portion, and when the knob is switched from the first position to a second position along an axial direction, the engaging portion is displaced by the positioning protrusion such that the positioning protrusion is switched to the other one of the two sides of the engaging portion.

5. The fastening device of claim 4, wherein the case unit further comprises:

a limiting portion located at the upper chamber and connected to the partition, the limiting portion configured to limit the engaging unit.

6. The fastening device of claim 5, wherein the limiting portion comprises four limiting arms spaced apart circumferentially around the through hole, and a free end of each of the limiting arms is configured to limit the engaging unit.

7. The fastening device of claim 6, wherein the knob comprises a plurality of first driving teeth, the engaging unit comprises a plurality of first combining teeth, when the knob is in the first position, the first driving teeth are engaged with the first combining teeth, and when the knob is in the second position, the first driving teeth are disengaged from the first combining teeth.

8. The fastening device of claim 7, wherein the knob further comprises:

a cap body covering on the case unit;

a post disposed at the cap body and protruding into the through hole; and a plurality of second driving teeth located at a distal end of the post to couple to the spool.

9. The fastening device of claim 1, wherein the case unit further comprises a plurality of mounting teeth located on the partition and facing toward the engaging unit.

10. The fastening device of claim 1, wherein the knob comprises:

a cap body covering on the case unit and comprising an annular side wall; and a plurality of mounting teeth located on the annular side wall of the cap body.

11. The fastening device of claim 1, wherein the knob comprises:

a cap body covering on the case unit and comprising a top surface; and a plurality of mounting teeth located on the top surface of the cap body.

12. The fastening device of claim 1, wherein the case unit further comprises a plurality of engaging protrusions located on the partition, and the engaging unit comprises a plurality of engaging cavities correspondingly engaged with the engaging protrusions.

* * * * *